US006917146B1

(12) United States Patent
Motoi et al.

(10) Patent No.: US 6,917,146 B1
(45) Date of Patent: Jul. 12, 2005

(54) ELECTRON-EMITTING DEVICE HAVING CARBON FILMS WITH A PARTICULAR ORIENTATION, ELECTRON SOURCE USING ELECTRON-EMITTING DEVICE, AND IMAGE FORMING APPARATUS

(75) Inventors: Taiko Motoi, Atsugi (JP); Masato Yamanobe, Machida (JP); Rie Ueno, Hadano (JP); Toshiaki Aiba, Fujisawa (JP); Kumi Nakamura, Isehara (JP); Masaaki Shibata, Ninomiya-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/443,308

(22) Filed: Nov. 19, 1999

(30) Foreign Application Priority Data

Dec. 8, 1998 (JP) ..... 10-348454
Feb. 22, 1999 (JP) ..... 11-0142908
Nov. 10, 1999 (JP) ..... 11-319289

(51) Int. Cl.[7] ..... H01J 1/62
(52) U.S. Cl. ..... 313/310; 313/495
(58) Field of Search ..... 313/310, 309, 313/336, 351, 355, 311, 495–497, 346 R; 445/24, 25, 50, 51, 6

(56) References Cited

U.S. PATENT DOCUMENTS

| | | | | |
|---|---|---|---|---|
| 6,005,334 A | | 12/1999 | Mitome et al. | 313/309 |
| 6,008,569 A | | 12/1999 | Yamanobe | 313/310 |
| 6,097,138 A | | 8/2000 | Nakamoto | |
| 6,179,678 B1 | | 1/2001 | Kishi et al. | |
| 6,184,610 B1 | * | 2/2001 | Shibata et al. | 313/309 |
| 6,246,168 B1 | | 6/2001 | Kishi et al. | |

FOREIGN PATENT DOCUMENTS

| | | |
|---|---|---|
| EP | 0 660 357 | 6/1995 |
| EP | 0 701 265 | 3/1996 |
| EP | 0 901 144 A1 | 3/1999 |
| EP | 0 701 265 B1 | 7/1999 |
| EP | 0 936 651 A1 | 8/1999 |
| JP | 7-235255 | 9/1995 |
| JP | 0 701 265 A1 | 3/1996 |
| JP | 10-149760 | 6/1996 |
| JP | 8-321254 | 12/1996 |
| JP | 10-149760 | 6/1998 |
| JP | 2836015 | 10/1998 |
| JP | 2903295 | 3/1999 |
| JP | 2000-173451 | 6/2000 |

OTHER PUBLICATIONS

C.A. Mead, "Operation of Tunnel–Emission Devices", Journal of Applied Physics, Apr. 1961, pp. 646–652.

M.I. Elinson et al., "The Emission of Hot Electrons and The Field Emission of Electrons From Tin Oxide", Radio Engineering and Electronic Physics, Jul. 1965, pp. 1290–1296.

H. Araki, "Electroforming and Electron Emission of Carbon Thin Films", Journal of the Vacuum, Society of Japan, 1983, pp. 22–29 (with English Abstract on p. 22).

(Continued)

*Primary Examiner*—Joseph Williams
(74) *Attorney, Agent, or Firm*—Fitzpatrick, Cella, Harper & Scinto

(57) ABSTRACT

An electron-emitting device includes a substrate, first and second carbon films disposed so as to have a first gap between the first and second carbon films on a surface of the substrate, and first and second electrodes electrically connected with the first and the second carbon films respectively, wherein the carbon film has a region showing orientation, and a direction of the orientation is in an approximately parallel direction along the substrate surface. Thereby, it is possible to improve thermal and chemical stability of a carbon film and stabilize good electron emission characteristics over a long period.

39 Claims, 19 Drawing Sheets

OTHER PUBLICATIONS

G. Dittmer, "Electrical Conduction and Electron Emission of Discontinuous Thin Films", Thin Solid Films, 9, 1972, pp. 317–328.
M. Hartwell, "Strong Electron Emission From Patterned Tin–Indium Oxide Thin Films", IEDM, 1975, pp. 519–521.
C.A. Spindt, "Physical Properties of Thin–Film Emission Cathodes with Molybdenum Cones", J. Applied Physics, vol. 47, No. 12, Dec. 1976, pp. 5248–5263.
J. Dyke et al., "Field Emission", Advances in Electronics and Electron Physics, vol. VIII, 1956, pp. 89–185.

* cited by examiner

ELECTRON-EMITTING DEVICE HAVING CARBON FILMS WITH A PARTICULAR ORIENTATION, ELECTRON SOURCE USING ELECTRON-EMITTING DEVICE, AND IMAGE FORMING APPARATUS

BACKGROUND OF THE INVENTION

1. Field of the Invention

This invention relates to an electron-emitting device, an electron source using the electron-emitting device, and an image forming apparatus.

2. Related Background Art

Conventionally, as an electron-emitting device, generally two kinds respectively using a thermionic cathode and a cold cathode are known. As the cold cathode, there is a field emission type (hereinafter referred to as an FE type), a metal/insulation layer/metal type (hereinafter referred to as an MIM type), a surface conduction type electron-emitting device or the like. As examples of the FE type, those which have been disclosed in W. P. Dyke & W. W. Dolan, "Field emission", Advance in Electron Physics, 8,89 (1956) or C. A. Spindt. "Physical Properties of thin-film field emission cathodes with molybdenium cones", J. Appl. Phys., 47.5248 (1976), etc. are known.

As examples of the MIM type, those which are disclosed in C. A. Mead", Operation of Tunnel-Emission Devices", J Apply. Phys. 32, 646 (1961), etc. are known.

As examples for the surface conduction type electron-emitting device, there are those which have been disclosed in M. I. Elinson, Radio Eng. Electron Phys, 10, 1290, (1965), etc.

The surface conduction type electron-emitting device is to utilize phenomena giving rise to the electron emission by making a current flow in parallel with the film surface at a small area of a film formed on a substrate. For this surface conduction type electron-emitting device, the one utilizing $SnO_2$ film by aforementioned Elinson et al., the one involving Au film (G. Ditmmer, Thin Solid Films, 9.317 (1972)), the one involving $In_2O_3/SnO_2$ film (M. Hartwell and C. G. Fonsted, IEEE Trans. ED Conf., 519 (1975)), and the one involving carbon film (Hisashi Araki, et al., Vacuum, vol. 26, the first issue, page 22 (1983)), etc. have been reported.

The present applicant has presented a number of proposals on surface conduction type electron-emitting devices having novel configurations and their applications. Its basic configuration and manufacturing method, etc. have been disclosed in for example Japanese Patent Application Laid-Open No. 7-235255, Japanese Patent No. 2836015, Japanese Patent No. 2903295, etc.

Now, their points are briefly described below.

An example of surface conduction type electron-emitting device disclosed in the above-described publication is schematically shown in FIGS. 5A and 5B. As in FIGS. 5A and 5B, the device is configured to comprise a pair of device electrodes 2 and 3 facing each other on the substrate 1, and conductive film 4 which is connected with the device electrodes and has an electron-emitting region 5 in a part thereof. FIG. 5A is its schematic plan view, and FIG. 5B is its schematic sectional view. The electron-emitting region 5 is a portion where a part of the conductive film 4 has been destroyed, deformed, or changed in quality. And the electron-emitting region has a fissure. On the substrate 1 inside the fissure and on its adjacent conductive film 4, the deposit comprising carbon and/or carbon compound as main ingredients has been formed with a step called activation process.

SUMMARY OF THE INVENTION

As for the surface conduction type electron-emitting device, further stable and long-lasting electron emission characteristics are desired so that the applied image forming apparatus can provide bright on-screen images on stable basis for a long period. If the electron emission characteristics controllable on stable basis, improvement of efficiency and long life are achieved, in for example an image forming apparatus comprising fluorescent substance as an image forming member, a low-power (low-voltage, low-current), bright and high definition image forming apparatus, for example a flat television, can be obtained. In an image forming apparatus, electrons emitted from an electron-emitting device reach a face plate being an anode to which a voltage of several kV has been applied, and lighten the fluorescent substance on the face plate to radiate.

However, a composition of the aforementioned carbon containing film (carbon film) could give rise to chemical changes due to the atmosphere surrounding the device or the like, or vaporize due to heat generated at the time of driving or various heating processes, etc. And, such chemical changes and vaporization could result in unstable or deteriorated electron emission characteristics.

Moreover, when the aforementioned vaporization takes place during driving pressure surrounding the device increases locally. Thus, discharge, etc. presumably due to the aforementioned vaporized substance could destroy conductive films or electrodes to give rise to a rapid deterioration of electron emission characteristics.

In addition, in the electron source in which the devices accompanied by the aforementioned vaporization are densely arranged, the distance among adjacent devices is short. Therefore, it is anticipated that the vaporized substance generated from one device could affect adjacent devices as well. As a result, in addition to that phenomena such as unstableness and deterioration of devices, and discharge, etc., become remarkable, decrease in uniformity of electron source or decrease in the on-screen image definition of an image forming apparatus could take place.

Under the circumstance, the purpose of the present invention is to obtain an electron-emitting device having a chemically and thermally stable carbon film thereby to obtain an electron-emitting device having over a long period stable electron emission characteristics and excellent electron emission efficiency. In addition, another purpose hereof is to obtain an electron source having excellent electron emission efficiency, and electron emission characteristics highly uniform over a long period. Further another purpose hereof is to obtain an image forming apparatus capable of controlling change and deterioration in the aforementioned electron emission characteristics and thereby obtaining highly uniform image over a long time.

Under the circumstances, as a result of a study contemplating on the above-described problems, the electron-emitting device of the present invention comprises a substrate, a first and a second carbon film having a first gap between them disposed on the surface of the substrate, and a first and a second electrode respectively electrically connected with the first and the second carbon film, wherein the carbon film has a region showing orientation, and the direction of the orientation is approximately parallel to the substrate surface.

The electron-emitting device of the present invention also comprises, a substrate, a first and a second electrode respectively having disposed on the substrate surface, a first and a second conductive film having a second gap disposed between the electrodes and respectively connected with the aforementioned and the second electrode, a first and a second carbon film having a first gap within the second gap and disposed so as to be respectively connected with the first and the second conductive film, wherein the first and the second carbon film respectively covers a part of the first and the second conductive film, and the carbon film disposed on the substrate surface has a region showing orientation, and a direction of the orientation is approximately normal direction to the substrate surface.

The electron-emitting device of the present invention also comprises a region where the carbon film does not show a particular orientation, wherein the region not showing a particular orientation is disposed between the region having orientation in the approximately parallel direction to the substrate surface and the region having orientation in the approximately normal direction to the substrate surface.

The present invention is further characterized by an electron source in which a plurality of the above-mentioned electron-emitting devices are arranged on the substrate, and is further characterized by an image forming apparatus having the above-mentioned electron source and an image forming member.

In the electron-emitting device of the present invention, excellent efficiency can be obtained on stable basis over a long period. In addition, in the electron source of the present invention, the electron emission characteristics excellent in uniformity and stable over a long period can be obtained. Moreover, in the image forming apparatus of the present invention, on-screen images excellent in uniformity can be obtained on stable basis over a long period.

DETAILED DESCRIPTION OF THE PREFERRED EMBODIMENTS

Now, with reference to the drawings the present invention will be described in detail.

Figure 1A:
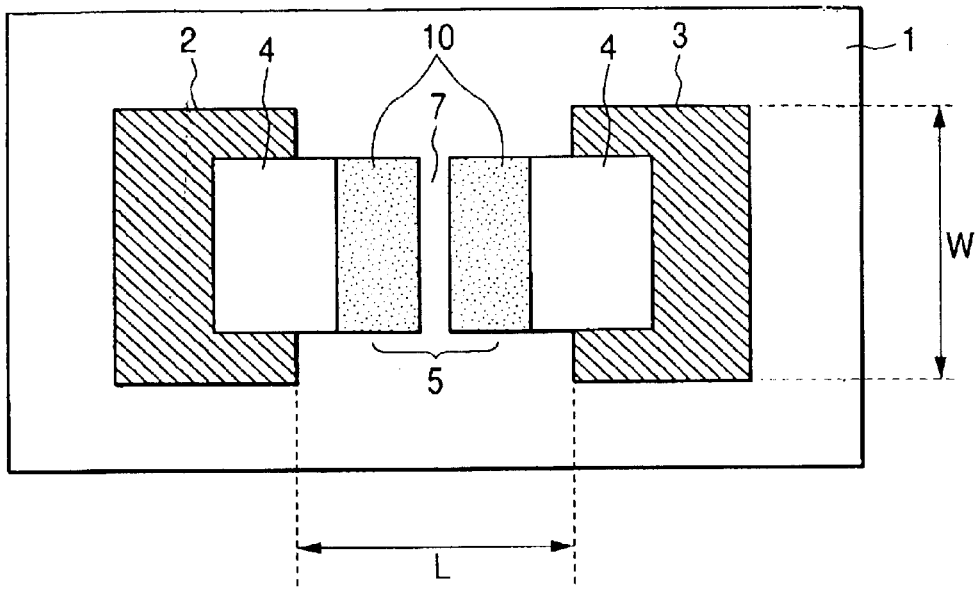
FIGS. 1A, 1B and 1C are a schematic plan view and sectional views showing a configuration of an electron-emitting device of the present invention.
Figure 1B:
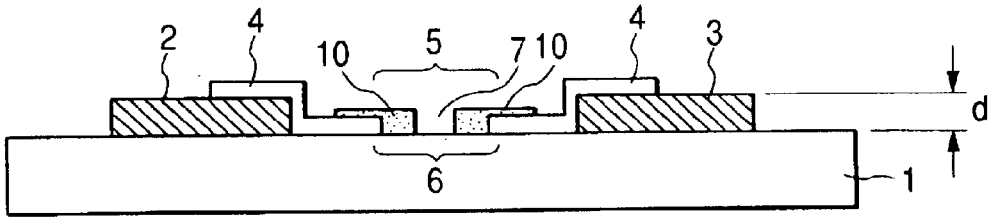

FIGS. 1A and 1B are a plan view and a sectional view representing as a schematic diagram a planar type electron-emitting device of the present invention. A pair of electrodes 2 and 3 are disposed facing each other on a substrate 1. A second gap 6 formed in a part of a conductive film 4 by the later-described forming step, etc. The conductive films 4 are facing each other substantially parallel to the surface of the substrate 1. And, the conductive film 4 covers for example the surface of the electrodes 2 and 3 as shown in FIGS. 2A to 2D, and thus a pair of electrodes and the conductive film are electrically connected. Connection between the conductive film 4 and the electrodes 2 and 3 may be disposed in such a manner that the electrodes 2 and 3 are disposed on the conductive film 4 and the like without being limited to the mode shown in FIGS. 2A to 2D. Incidentally, as shown in FIGS. 1A and 1B, the conductive film 4 is separated left and right with the gap 6 as a center to be disposed facing each other, but in some cases could remain not-perfectly separated at one part in the second gap 6.

Moreover, the later-described activation step disposes a film comprising carbon (carbon film) 10 on the substrate 1 within the second gap 6 and on the adjacent conductive film 4.

The film comprising carbon (carbon film) 10 is disposed facing each other substantially parallel to the surface of the substrate 1 over the first gap 7 as a center disposed within the second gap 6.

Figure 22A:
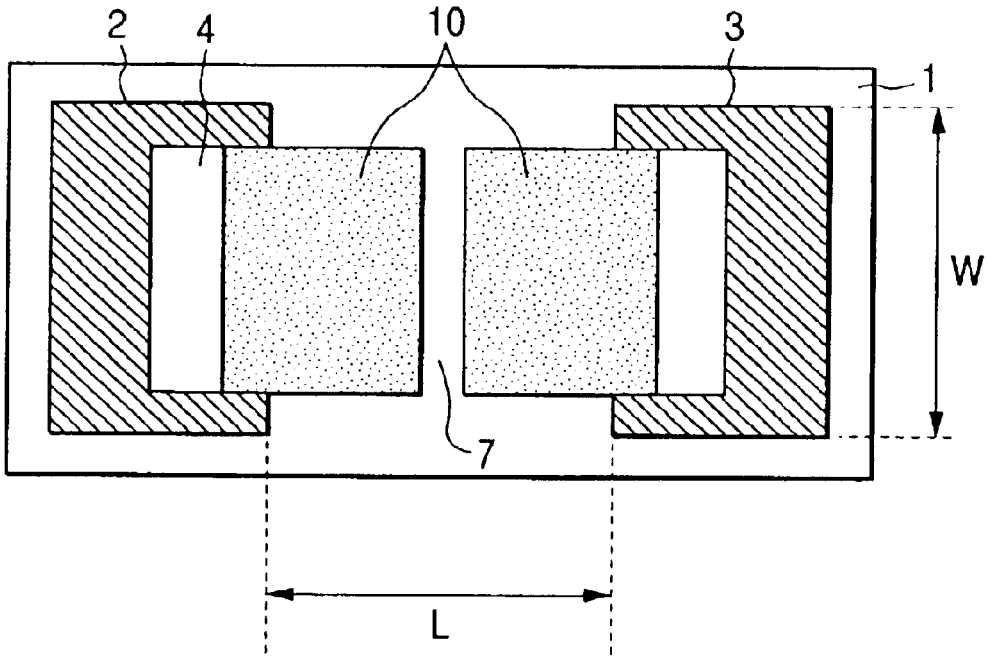
FIGS. 22A and 22B are schematic diagrams showing another mode of electron-emitting device of the present invention.
Figure 22B:
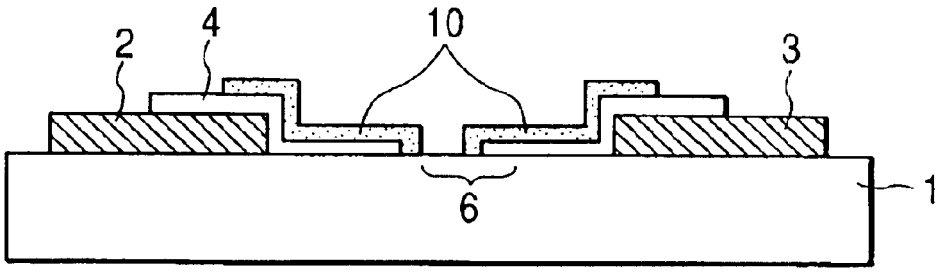

This film comprising carbon 10 can cover to reach above the device electrodes 2 and 3 as shown in FIGS. 22A and 22B, depending on distance between electrodes (L) and later-described activation conditions, etc., and moreover, without using the conductive film 4, the electrodes 2 and 3 can be connected directly to the carbon films 10. Although details are described later, the conductive film 4 is extraordinary thin film and thus is apt to thermal structural changes and compositional changes such as aggregation (cohesion), etc., due to heat at the time of manufacturing process and at the time of driving. Therefore, in the present invention, in the case where the conductive film is used, the above-described carbon film 10 covers the conductive film surface, preferably. And, especially, entire coverage of the conductive film surface located between the electrodes 2 and 3 preferably controls variation in the device characteristics due to thermal structural changes of the conductive film, etc. In addition, in the case where the conductive film is not used, the gap between the device electrodes is equivalent to the aforementioned second gap.

Incidentally, as shown in FIGS. 1A and 1B, the film comprising carbon (carbon film) 10 is separated left and right with the gap 7 as a center to be disposed facing each other, but in some cases the film comprising carbon (carbon film) 10 could remain not-perfectly separated at one part in the first gap 7.

Figure 1C:
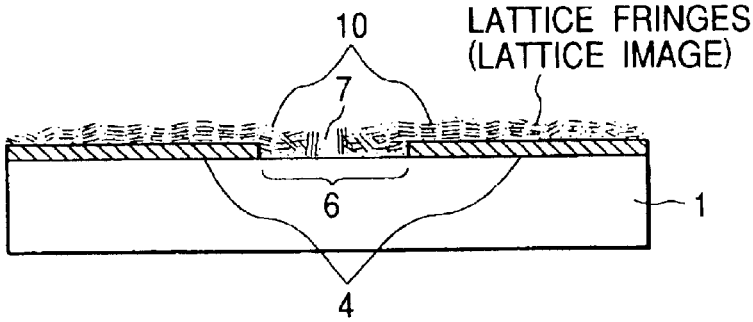

A voltage is applied between the electrodes 2 and 3 so that the electron-emitting device of the present invention shown in FIGS. 1A to 1C configured as described so far causes electrons to be emitted from the electron-emitting region 5.

In addition, thickness of the film comprising carbon 10 is preferably set within a range not less than 5 nm and not more than 100 nm.

In the electron-emitting device of the present invention, the carbon film 10 has particular orientation. In other words, the carbon film has a region showing the orientation of the carbon atoms. Orientation in the present invention refers to a direction to which lattice fringes (lattice image) equivalent to graphite (002) plane (normal direction to lattice fringes (lattice image)) are laminated.

Figure 19A:
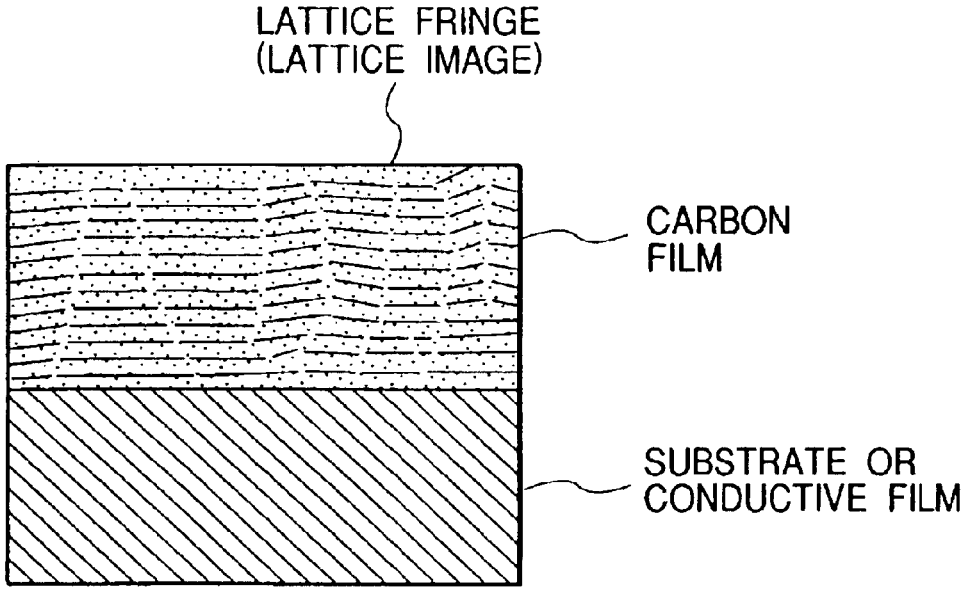
FIGS. 19A and 19B are a schematic diagram showing lattice fringes (lattice image) and orientation thereof in a region apart from the gap portion 6 of the film containing carbon of the present invention.
Figure 19B:
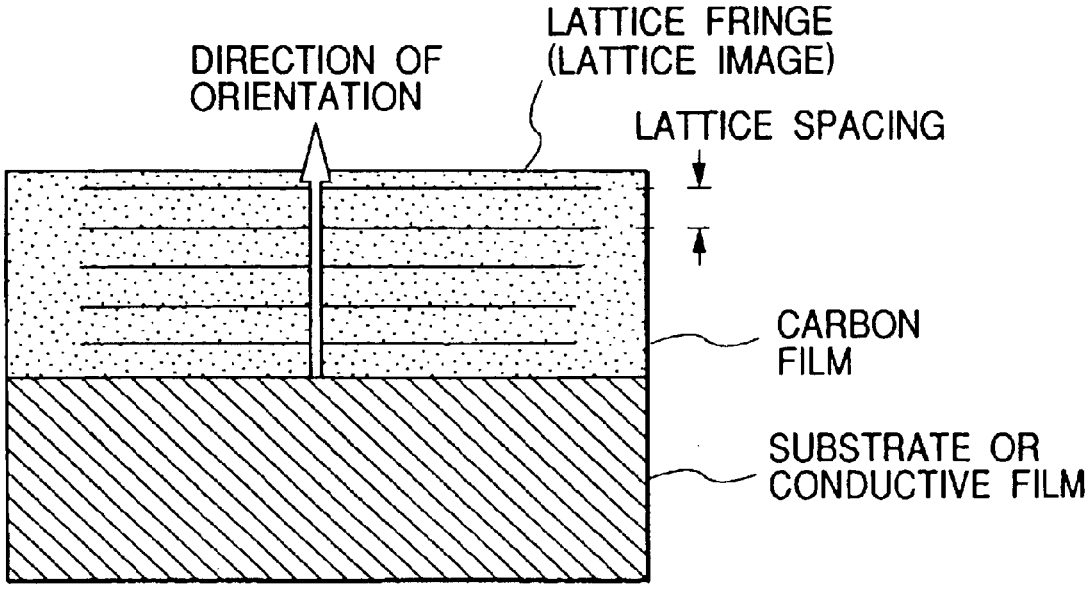

And, for the above-described carbon film disposed on at least the conductive film 4 (on the electrodes 2 and 3 for a mode without using a conductive film), the lattice fringes (lattice image) equivalent to graphite (002) plane are configured to have orientation in the direction of approximate perpendicular against the surface of the substrate, the sectional schematic diagram of which has been shown in FIGS. 1C, 19A and 19B.

FIG. 19A is a sectional view having schematically shown the lattice fringes (lattice image) observed on the above-described conductive film 4, and the FIG. 19B is a sectional schematic diagram showing a part of FIG. 19A which has been magnified.

Incidentally, also in a mode without using the aforementioned conductive film 4, the lattice fringes (lattice image) observed in the carbon film on the electrodes 2 and 3 are basically the same as those shown in the schematic diagram of FIGS. 19A and 19B.

The carbon film 10 is, as described above, disposed in a state of an extremely thin film, and many regions thereof have been disposed on the aforementioned conductive film and/or on the aforementioned electrodes.

Thus, the above-described carbon film disposed on at least the conductive film 4 (on the electrodes 2 and 3 for a mode without using a conductive film) is adopted as the carbon film 10 which has orientation in the direction of approximate perpendicular against the surface of the substrate so that larger part of the carbon film being exposed in the atmosphere surrounding the device can be made thermally and chemically stable. As a result, various evaporation and chemical changes from the film containing carbon due to heating step at the time when the electron-emitting device is driven or at the time of manufacturing an image forming apparatus and the like can be suppressed. Moreover, since effects due to absorption of impurities and the like are reduced, electron emission characteristics stable over a long time can be obtained.

Incidentally, the direction of orientation of the lattice fringes (lattice image) falls within the range of ±30 degrees from the normal to the surface of the substrate having shown in FIGS. 19A and 19B. In addition, the direction of orientation of lattice fringes (lattice image) herein is referred to as a direction to which the lattice fringes (lattice image) equivalent to graphite (002) plane are arranged in a lamination manner (normal direction to lattice fringes (lattice image)).

In addition, the lattice spacing of the above-described lattice fringes (lattice image) are preferably comprised with those of not more than 4.7 Å, and moreover, are further preferably comprised with those of not less than 3.5 Å and not more than 4.7 Å.

Moreover, the film containing carbon (carbon film) 10 of the present invention is preferably configured so that lattice fringes (lattice image) (orientated direction) equivalent to graphite (002) plane are orientated in the substantially parallel direction to the surface of the substrate 1.

Figure 18A:
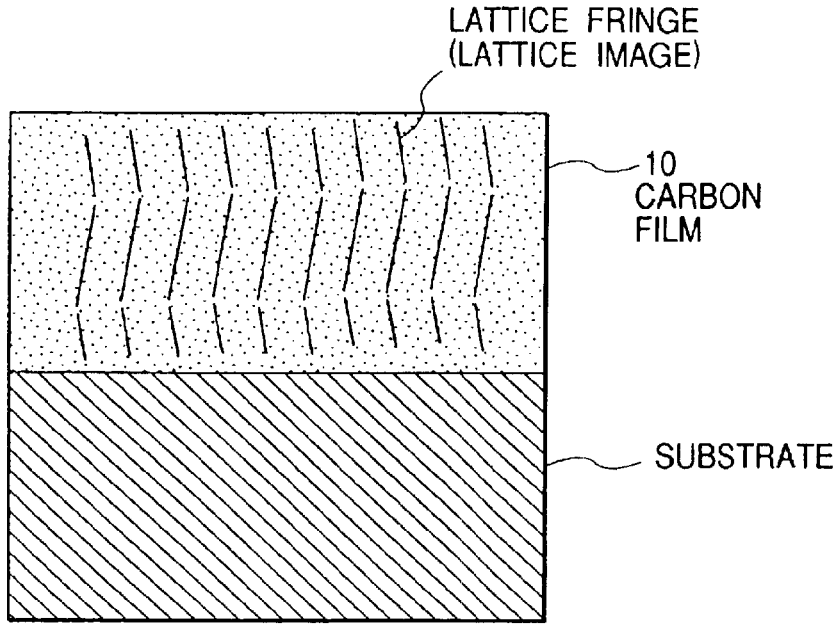
FIGS. 18A and 18B are a schematic diagram showing lattice fringes (lattice image) and orientation thereof in a region adjacent gap portion 6 of the film containing carbon of the present invention.
Figure 18B:
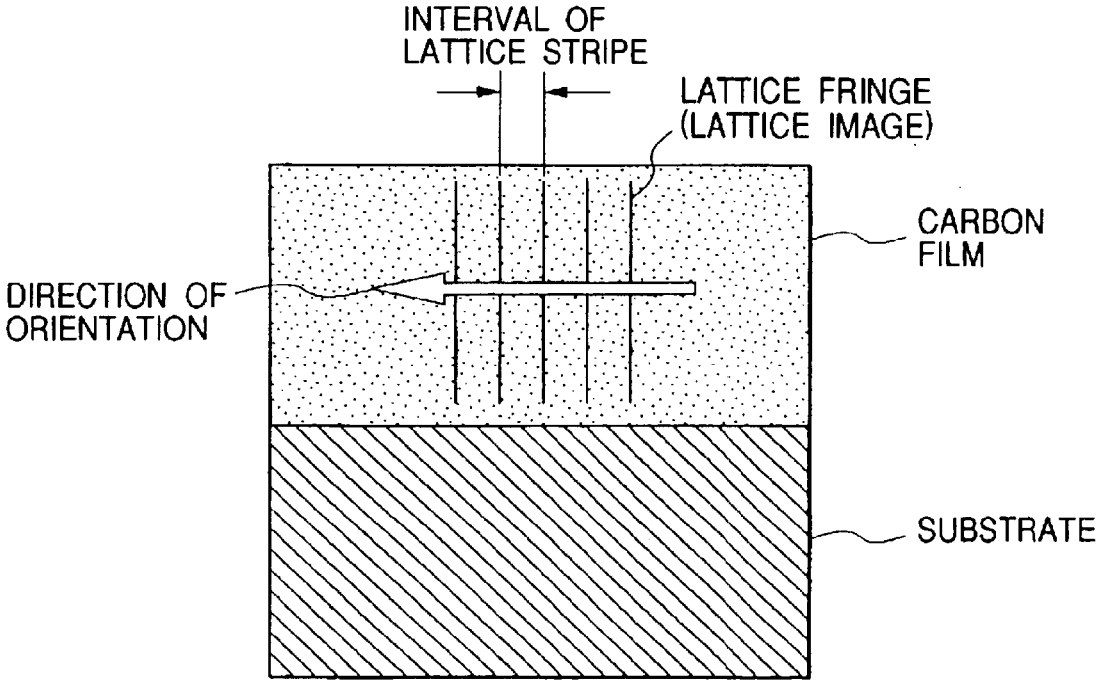

The lattice fringes (lattice image) orientated in the parallel direction to the surface of the above-described substrate 1 are, as schematically shown in FIGS. 1C, 18A and 18B, most preferably disposed in the vicinity of the first gap 7, that is, in the regions facing each other with the first gap 7 as a center.

FIG. 1C schematically shows sectional viewing of the lattice fringes (lattice image) of the film containing carbon observed adjacent the gap 6 having shown in FIG. 1B.

The carbon film 10 of the portion facing the above-described first gap 7 is extremely thin, but has finite thickness, and is a portion forming the first gap. Moreover, adjacent the above-described first gap is a region where largest quantity of heat is generated when the device is being driven, a region where strong electric fields are applied, and among others, a place where electrons are emitted. Therefore, it is preferable that the region in the vicinity of the above-described first gap is chemically and thermally stable. That is, absorption of impurities, etc. which might take place on the surface of the carbon film in the portion which faces the first gap could give rise to chemical compositional change, etc., and furthermore could give rise to a variation of work function. In addition, when reaction with atmosphere surrounding the device results in vaporization of composed substance of carbon films, or heat results in evaporation of composed substance of carbon films, the shape of the first gap 7 might have changed. Consequently, it is possible that these result in variation and deterioration of electron emission characteristics.

Accordingly, the direction of the orientation of the carbon film 10 at the portion facing the first gap is in the approximately or substantially parallel to the surface of the substrate as described above, thus chemical stability and thermal stability can be obtained.

FIG. 18A is a sectional view on the lattice fringes (lattice image) in the vicinity of the first gap 7 having been shown in FIG. 1C, which have been magnified and schematically shown, and FIG. 18B is a schematic diagram showing the lattice spacing and the orientation of lattice fringes (lattice image).

As shown in FIG. 18B, the lattice fringes (lattice image) equivalent to the graphite (002) plane observed in the vicinity of the first gap 7 of the film comprising carbon (carbon film) 10 of the present invention have orientation in the approximately or substantially parallel to the surface of the substrate 1. The lattice fringes (lattice image) orientated to this direction are preferably disposed in the region of the distance of 100 nm from the end portion of the film comprising carbon (carbon film) 10 regulating the first gap 7 toward the direction of the electrodes 2 and 3.

Incidentally, the orientation of lattice fringes (lattice image) falls within the range of ±45 degrees from the substantially horizontal (parallel) line along the surface of the substrate having shown in FIG. 18B. In addition, the direction of orientation of lattice fringes (lattice image) herein is referred to as the direction to which the lattice fringes (lattice image) equivalent to graphite (002) plane are arranged in an overlapping manner (normal direction against lattice fringes (lattice image)).

In addition, the intervals of the lattice fringes (lattice image) orientated to the approximately or substantially parallel to the surface of the substrate 1 are preferably comprised with those of not more than 4.7 Å, and moreover, are further preferably comprised with those of not less than 3.5 Å and not more than 4.7 Å.

Figure 20:
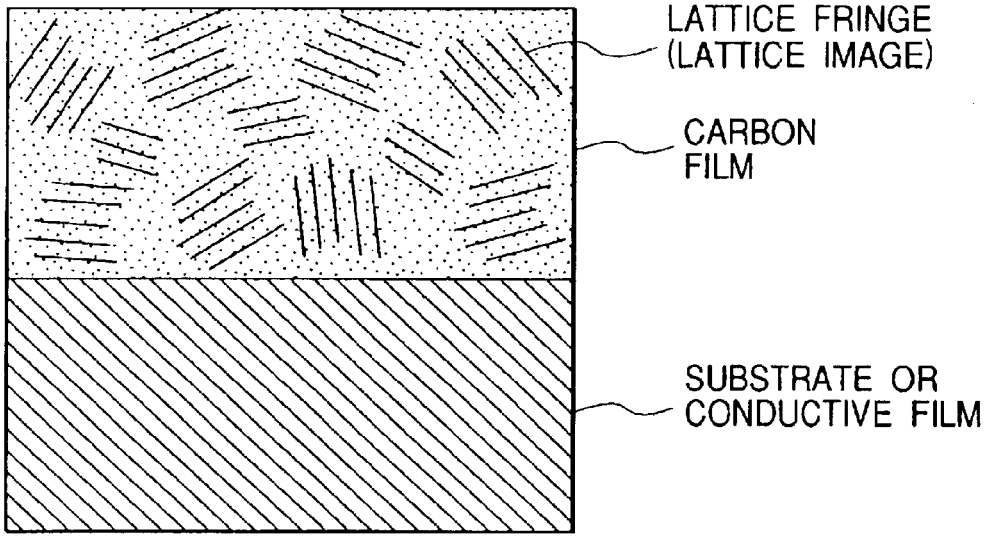
FIG. 20 is a schematic diagram showing lattice fringes (lattice image) and orientation thereof in a region between a region adjacent the gap portion 6 of the film containing carbon of the present invention and a region apart from the gap portion 6.

Moreover, for a preferable mode of the carbon film 10 of the present invention, the carbon configuring the film comprising carbon (carbon film) 10 preferably has the configuration so that the lattice fringes (lattice image) equivalent to the graphite (002) plane does not show a particular orientated direction, as in FIG. 20 in which its sectional schematic diagram has been shown, in the region between the region where the lattice fringes (lattice image) in the vicinity of the first gap 7 have orientation in the approximately parallel direction to the surface of the substrate and the region where the lattice fringes (lattice image) have orientation in the approximately normal direction to the surface of the substrate.

Since such a configuration makes the shape of the film comprising carbon structurally and also thermally stable in the region where orientation changes, an electron-emitting device having stable electron emission characteristics over a further long time can be obtained.

Here, the expression "do not show a particular orientated direction" includes those cases that the orientation, literally, cannot be specified by way of the later-described observation method, that in the direction of film thickness of the film comprising carbon (carbon film) 10 the orientation is directed in both ways defined to the aforementioned parallel direction and normal direction, and that the orientation includes the direction which does not fall within the range to be defined toward the above-described parallel direction and perpendicular direction.

As described so far, the most preferable mode of the film comprising carbon 10 of the present invention is configurations that the lattice fringes (lattice image) in the vicinity of the first gap 7 are orientated to the substantially parallel direction to the surface of the substrate, and the lattice fringes (lattice image) remote from the first gap 7 are orientated to the approximately normal direction to the surface of the substrate, and moreover the lattice fringes (lattice image) in the region which does not separate the both parties doe not show a particular orientated direction (FIG. 1C). And as shown in FIG. 1C, it will become important from the point of view of safety of electron emission characteristics that the carbon film 10 having the above-described orientation has been disposed approximately symmetrically so as to sandwich the first gap 7.

Incidentally, FIG. 1C shows an example that the region (the region does not show a particular orientated direction) connecting the region where the lattice fringes (lattice image) in the vicinity of the first gap 7 are orientated in the parallel direction to the surface of the substrate and the region where the lattice fringes (lattice image) remote from the first gap 7 are orientated in the approximately normal direction to the surface of the substrate are positioned on a substrate within the second gap 6. However, as aforementioned, in the case where no conductive films are provided, or depending on the distance between electrodes or the interval of the second gap, the region not showing a particular orientated direction could be located on the conductive film or electrodes.

The lattice stripe observed in the film comprising carbon (carbon film) 10 in the aforementioned present invention, and the orientation of lattice fringes (lattice image) and the intervals of lattice fringes (lattice image) are evaluated and observed as follows.

As an example of evaluation method, FIB (focused ion beam)-TEM (transparent electron magnifier) method are nominated, but the evaluation method is not limited to this method unless there is no inconvenience to evaluate the orientation of the film comprising carbon (carbon film).

In this evaluation method, FIB process has been used to produce samples for sectional TEM observation, and thus this pieces with thickness of not more than 100 nm can be produced in the region having length of several 10 $\mu$m so as to include the gaps 6 and 7, and it is possible to evaluate with TEM the sections of the film comprising carbon 10 in the electron emission unit and in the vicinity thereof and surrounding it.

Next, as concerns the evaluation method of orientation of the film comprising carbon 10 with TEM, generally three methods are nominated as shown below.

(1) A highly magnified TEM image of the film comprising carbon 10 is photographed and the lattice fringes (lattice image) of the film comprising carbon 10 are observed. Here, the direction of orientation is given by the direction of lattice fringes (lattice image) and the lattice spacing is given from the distance between the fringes.

(2) The diffraction pattern obtainable when the micro probe is set onto the film comprising carbon 10 is photographed to measure distribution of intensity of diffraction ring. At this time, in the case when carbon 10 have an orientation, distribution of intensity of diffraction ring became heterogeneous, and the direction with stronger intensity of diffraction ring will become the orientation direction. In addition, the interval of lattice fringes is given by the distance between the position with the maximum intensity of diffraction ring and the origin of the diffraction pattern.

(3) The image obtained by photographing the lattice fringes of a highly magnified TEM image of the film comprising carbon 10 undergoes Fourier transform so that the diffraction pattern is obtained to measure distribution of intensity of diffraction ring. At this time, in the case when carbon 10 have an orientation, distribution of intensity of diffraction ring became heterogeneous, and the direction with stronger intensity of diffraction ring will become the orientation direction. In addition, the interval of lattice fringes is given by the distance between the position with the maximum intensity of diffraction ring and the origin of the diffraction pattern.

Here, after obtaining the diffraction pattern as in (2) and (3), the intensity of orientation can also be converted into numeric values by way of comparing the intensity of diffraction ring in the orientated direction with the intensity of diffraction ring in the vertical direction to the oriented direction (for example, obtaining the intensity ratio).

However, the method described so far can be almost equivalent in principle and any method may be used for the evaluation of orientation without any inconveniences.

Next, an example of manufacturing method of the electron-emitting device of the present invention is described below. The step of forming the device electrodes and the conductive films, and the forming step, activation step is described briefly using FIGS. 2A to 2D.

Figure 2A:
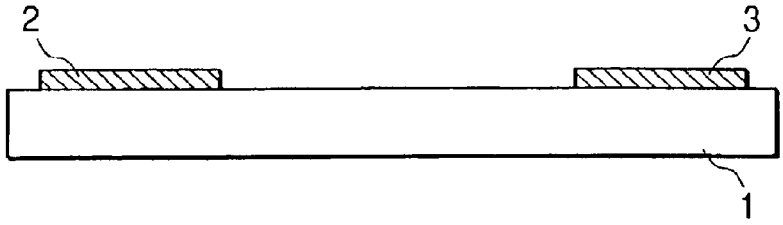
FIGS. 2A, 2B, 2C and 2D are schematic diagrams showing a part of manufacturing process of an electron-emitting device of the present invention.

1) The substrate 1 is sufficiently cleaned with detergent, pure water, and organic solvent, etc., and after the device electrode material is deposited with vacuum evaporation method, and sputtering method, etc., the device electrodes 2 and 3 are formed on the substrate 1 using for example photolithography technology (FIG. 2A).

Incidentally, as aforementioned, in the case where the film comprising carbon (carbon film) 10 is formed on the electrodes 2 and 3 without using the conductive film 4, the interval between the electrodes 2 and 3 may well set at around the second gap 6 to be formed with the later-described forming step using for example FIB method, etc., and in that case the following steps of 2) and 3) can be omitted. However, to form the device of the present invention on costly effective basis, it is preferable to form it with use of the above-described conductive film 4.

Figure 2B:
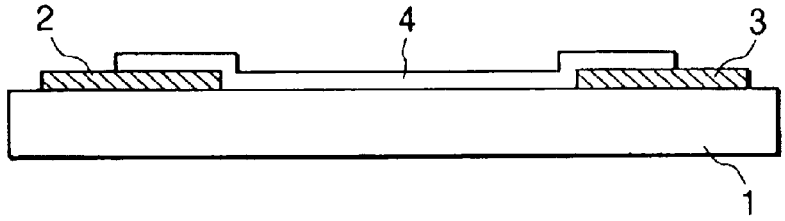

2) The substrate 1 has been provided with the device electrodes 2 and 3, to which, for example, organic metal compound solution is applied to form the organic metal compound film. In succession, the organic metal compound film undergoes baking and calcinating processing, and undergoes patterning by liftoff, and etching, etc., and the conductive film 4 is formed (FIG. 2B). Here, the application method of organic metal solution has been nominated for description, but the forming method of the conductive film 4 is not limited to this, but a vacuum evaporation method, sputtering method, chemical vapor depositing method, scattered application method, dipping method, spinner method, etc. can be used. In addition, a method of giving the aforementioned organic metal compound solution as liquid drops at desired positions with an ink jet method can be used, and in this case the patterning step with liftoff or etching will become unnecessary.

Film thickness of the conductive film 4 is appropriately set putting step coverage to the electrodes 2 and 3, the resistance value of between the electrodes 2 and 3, and the later-described forming conditions, etc. under consideration, but normally, it will preferably fall within the range of several Å to several thousand Å, and more preferably from 10 Å to 500 Å. For those resistance values, Rs is a value of from $10^2$ Ω/□ to $10^7$ Ω/□. Incidentally, Rs emerges when resistance R of a film of thickness "t", width "w", and length l is set at R=Rs(l/w). In the present applied specification, the forming processing is described taking conductive processing as an example, but the forming processing will not be limited to this, but will be inclusive of the processing to form the second gap 6 into the conductive film 4.

Materials consisting the conductive film 4 are appropriately selected from metals such as Pd, Pt, Ru, Ag, Au, Ti, In, Cu, Cr, Fe, Zn, Sn, Ta, W, and Pb, etc., oxide compound such as PdO, $SnO_2$, $In_2O_3$, PbO, $Sb_2O_3$, etc., boron compound such as $HfB_2$, $ZrB_2$, $LaB_6$, $CeB_6$, $YB_4$, $GdB_4$, etc., carbon compound such as TiC, ZrC, HfC, TaC, SiC, WC, nitrogen compound such as TiN, ZrN, HfN, etc., and semiconductors such as Si, Ge, etc. and the like.

Figure 2C:
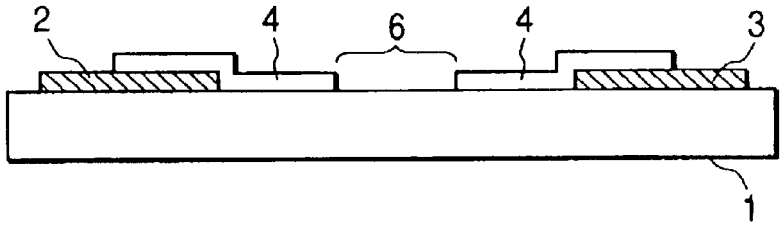

3) In succession, forming step is implemented. As an example of step of this forming method, the method by way of conductive processing is explained. The above-described electron-emitting device having formed the conductive film 4 is disposed in the vacuum apparatus, and the interior atmosphere is exhausted so as to get a pressure of for example $1\times10^{-5}$ Torr and the like, and not-shown power source is used between the electrodes 2 and 3 so as to applying voltage, then the second gap 6 is formed in the conductive film 4 (FIG. 2C).

As the voltage wave form to be used for the above-described forming process, pulse wave forms are preferable. This includes technique to apply pulse with pulse wave height value of a constant voltage on continuous basis as having shown in FIG. 4A, and technique to apply voltage pulses while increasing pulse wave height value as having shown in FIG. 4B.

Figure 4A:
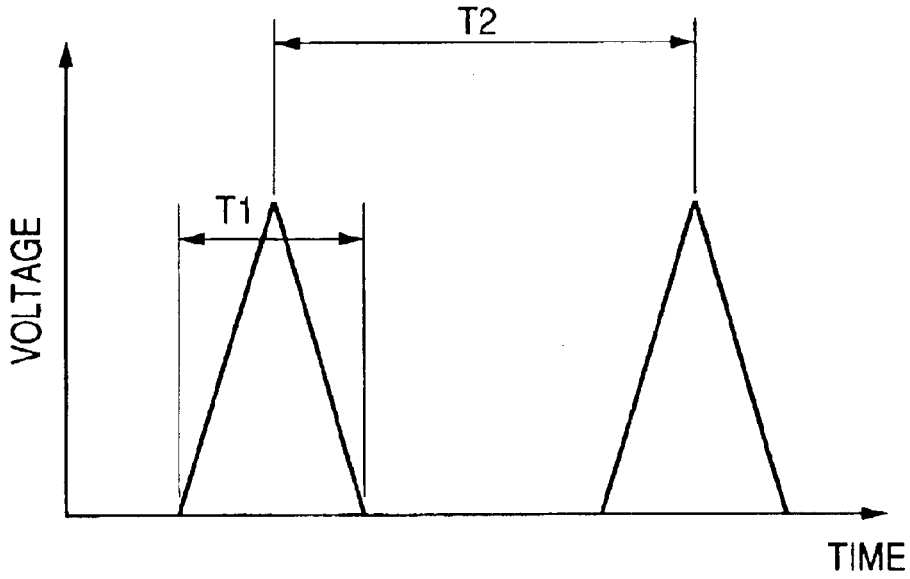
FIGS. 4A and 4B are schematic diagrams showing an example of voltage wave form available for use in the forming step being a part of manufacturing step of the electron-emitting device of the present invention.

T1 and T2 in FIG. 4A is the pulse width and the pulse interval of a voltage wave form. Normally T1 is from 1 μsec to 10 msec, and T2 is set to fall within the range from 10 μsec to several 100 msec. Under such conditions, voltage is applied for the period of for example from several seconds to several ten minutes. The pulse wave from is not limited to triangular wave, but desired wave forms such as rectangular wave can be adopted.

Figure 4B:
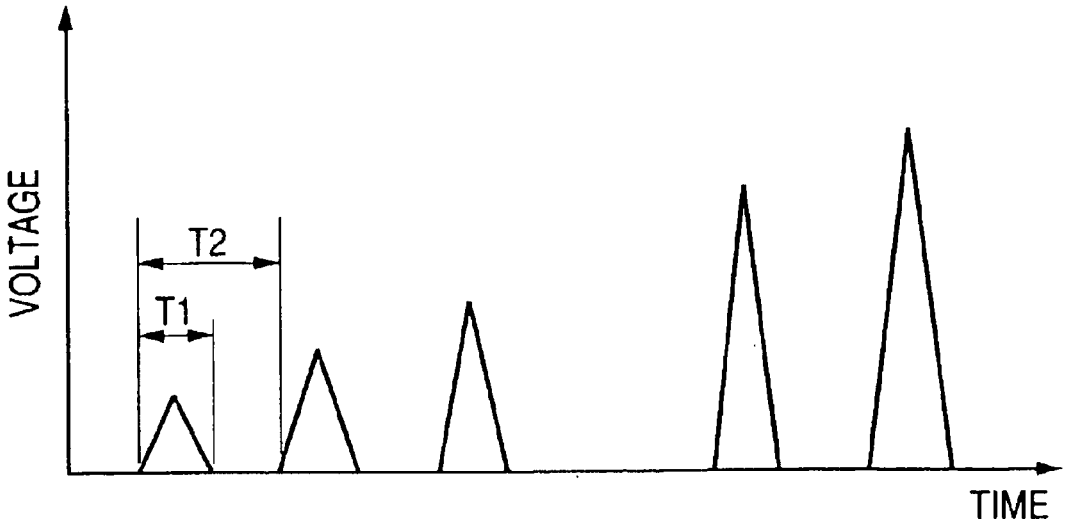
Figure 5A:
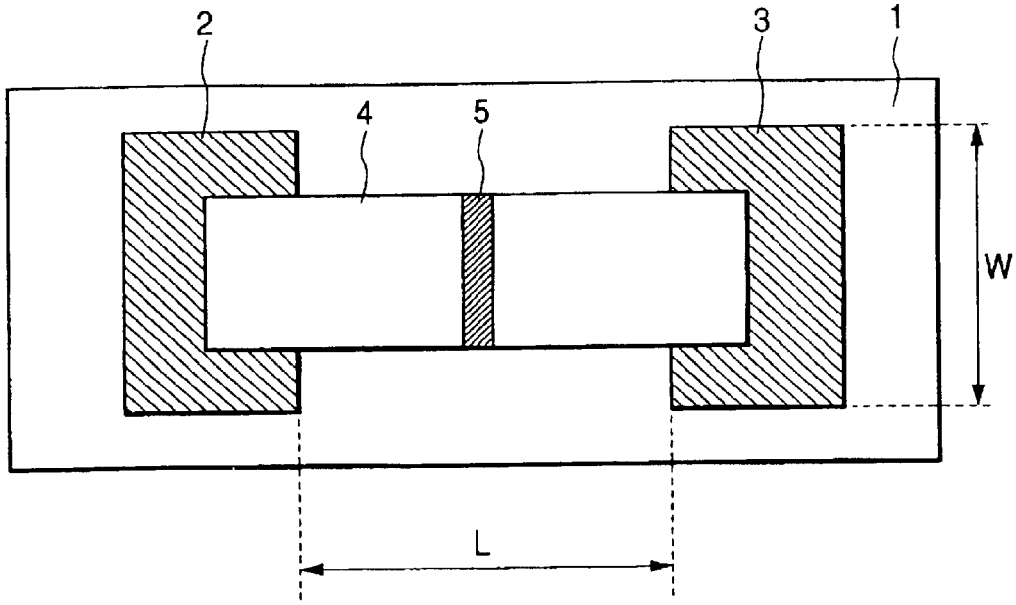
FIGS. 5A and 5B are a schematic plan view and a sectional view showing a configuration of a conventional electron-emitting device.
Figure 5B:
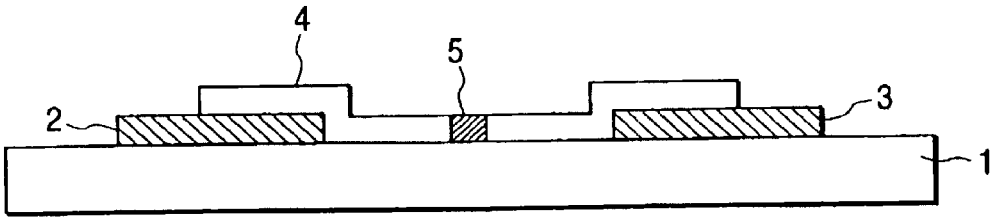

T1 and T2 in FIG. 4B may be those shown in FIG. 4A. In addition, wave height value of triangular wave may be increased at a desired rate, for example, approximately every 0.1 V step.

The conclusion of the forming processing is determined by, for example, inserting pulse voltage between the pulse voltages for above-described forming process to an extent which will not locally destroy nor deform the conductive film 4, and measuring the current at that time to detect the resistant value. For example, measuring the device current which flows when a voltage around 0.1V is applied and obtaining the resistance values, and when resistant not less than 1,000 times as large as a resistance before the forming processing is indicated, forming process is concluded.

Incidentally, as the method of forming process, other than the above-described methods, any method which form the second gap 6 appropriately can be adopted.

4) Next, the activation step is implemented. For example, the activation step of the present invention is a step where under the atmosphere containing gas of acrylonitrile a pulse voltage is repeatedly applied to between the above-described pair of device electrodes, and the film comprising carbon (carbon film) 10 having the aforementioned configuration is disposed on the substrate inside the gap 6 and on the conductive film 4 surrounding the gap 6.

This step forms the first gap 7 narrower than the second gap 6 inside the second gap 6. In addition, due to the activation step, the current flowing between the electrodes 2 and 3 (device current If) incurs remarkable changes, and the electron emission current Ie also increases. The conclusion of the activation step is appropriately implemented while the device current If is being measured. Incidentally, the pulse width, the pulse interval, the pulse wave height value, etc. are appropriately set.

The current flows between the electrodes 2 and 3, which shows that the film comprising carbon 10 having been formed in the activation step is electronically connected with the electrodes 2 and 3.

In addition, for the purpose of forming the region having orientation in the approximately parallel direction to the aforementioned substrate surface and the region not showing any particular orientation (disordered region), it is preferable to perform a step of removing gas while heating the device and the substrate 1 before implementing the activation step after the above-described forming step. In addition, removing gas while heating as mentioned above will preferably provide a pressure lower than the above-mentioned pressure at the time of forming step, and moreover, the gas pressure introduced in the present activation step is more preferably lower than the above-mentioned pressure at the time of forming step.

5) The electron-emitting device obtained over the above-described step preferably undergoes a stabilization step. This step is a step of removing organic substance molecules, etc. adsorbed to the electron-emitting devices. This step is implemented by disposing the above-mentioned electron-emitting devices inside the vacuum container and removing gasses inside the container.

As the vacuum apparatus to be used in this step, the one not using oil is preferable so that the oil spilt out from the apparatus may not proliferate to inside the vacuum container. In particular, they are a vacuum apparatus in combination of an adsorption pump and an ion pump, etc. This evacuation will preferably produce allocated pressure of organic components inside the vacuum container at not more than $1\times10^{-8}$ Torr being allocated pressure which will not cause the above-mentioned carbon and carbon compound to almost newly deposit, and moreover, especially preferably at not more than $1\times10^{-10}$ Torr. In addition, when the vacuum container is evacuated inside, it is preferable that the whole vacuum container is heated so that the organic substance molecules absorbed by the interior walls of the vacuum container and the electron-emitting devices can be easily removed.

At this time, the heating condition falls within the range of 80 to 300° C. and preferably is 150° C. or higher with which the processing preferably continues as long as possible, but heating will not especially be limited to this condition, but heating will be implemented under conditions appropriately selected according to respective conditions such as sizes and shape of the vacuum container, configuration of the electron-emitting device, etc. It is also necessary to lower the pressure inside the vacuum container (the total pressure) to the utmost, and the preferable pressure is $1\times10^{-7}$ Torr or less, and moreover, $1\times10^{-8}$ Torr or less is especially preferable.

The above-described atmosphere at the time of driving after having undergone the stabilization processing preferably maintains the atmosphere at the time of conclusion of the above described stabilization processing, but without limitation thereto, if organic substances are sufficiently removed, sufficiently stable feature can be maintained even if the state of vacuum might be more or less worse.

Undergoing such a step, any new deposit of carbon or carbon compound onto the elements can be controlled.

In addition, $H_2O$ and $O_2$, etc. which absorbed by the vacuum container and the substrate, etc. can be removed, and as a result, the device current If and the emission current Ie are stabilized.

Basic features of the electron-emitting device to which the present invention having been obtained undergoing the above-described step is applicable are described with reference to FIG. 3 and FIG. 7.

Figure 3:
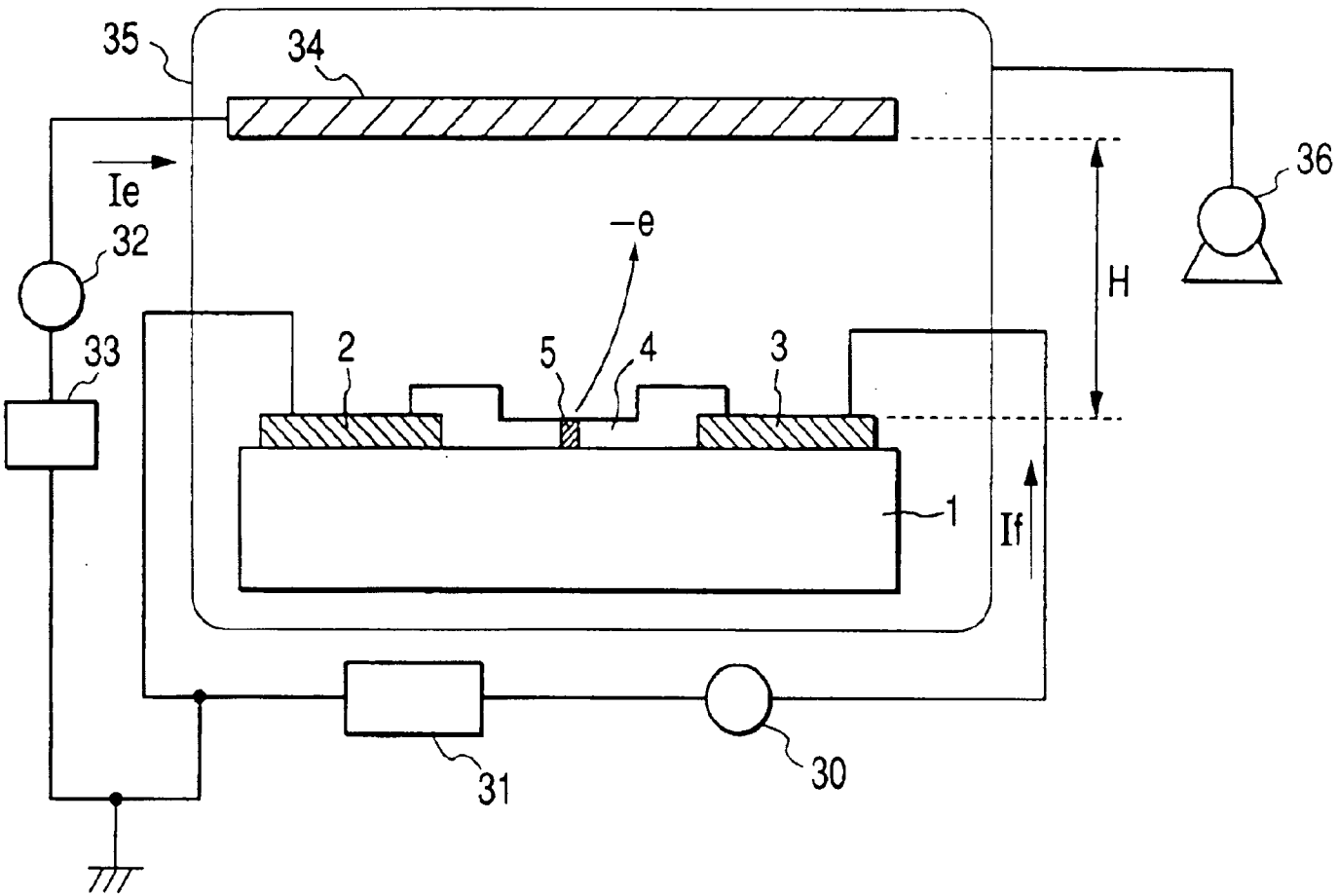
FIG. 3 is a schematic diagram showing an example of configuration of a vacuum processing system provided with measurement-evaluation function.

FIG. 3 is a schematic diagram drawing showing an example of the vacuum processing device, and this vacuum processing device is also equipped with functions to work as a measurement evaluation system. In FIG. 3, a vacuum container is numbered as 35, and the ventilation pump is numbered as 36. Inside the vacuum container 35, the electron-emitting device which has completed steps up to the aforementioned stabilization step is disposed. That is, a substrate configuring the electron-emitting device is numbered 1, electrodes are numbered 2 and 3, a conductive film is numbered 4, an electron-emitting region being the region adjacent the aforementioned gap 7 is numbered 5. A power source to apply the device voltage Vf to the electron-emitting device is numbered 31, an ammeter to measure the device current If flowing through the conductive film 4 between the electrodes 2 and 3 is numbered as 30, and an anode electrode to capture the emission current Ie emitted from the electron emission portion 5 is numbered 34. A high voltage power source to apply a voltage to the anode electrode 34 is numbered 32, and an ammeter to measure the emission current Ie due to electron emission by the device is numbered 33. As an example, the measurement can be implemented by involving the voltage of the anode electrode being set to fall within the range of 1 kV to 10 kV and the distance H between the anode electrode and the electron-emitting device being set to fall within the range of 2 mm to 8 mm. In addition, inside the vacuum container 35, equipment necessary to implement measurement under vacuum atmosphere such as a vacuum meter, etc. is provided so that measurement and evaluation under a desired vacuum atmosphere can be implemented. In the case where the one which the power source 31 can supply with sufficient power is used, this device can proceed with the above-described forming step as well. In addition, moreover, the entire vacuum processing device and device can be heated by a heater to be usable to the above-mentioned stabilization step.

Figure 7:
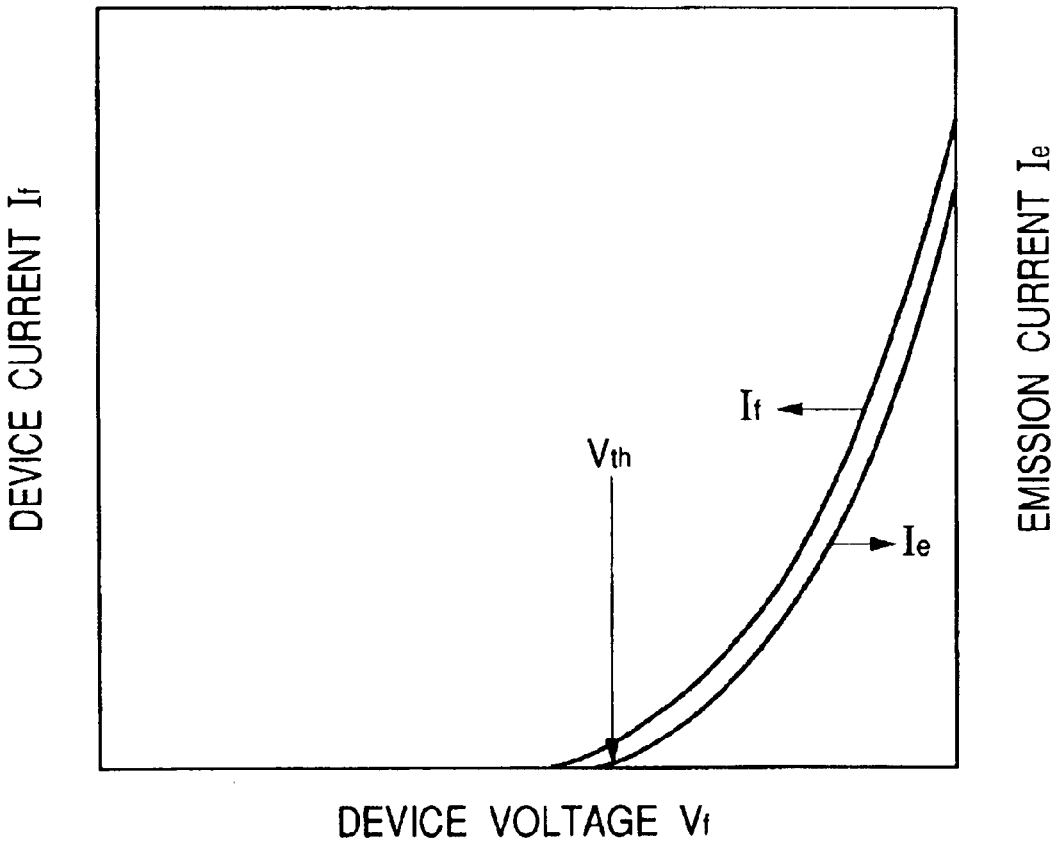
FIG. 7 is a schematic diagram showing relationships between the emission current Ie and the device voltage Vf and between the device current If and the device voltage Vf, of an electron-emitting device of the present invention.

FIG. 7 is a drawing having schematically shown the relationships between the emission current Ie of the electron-emitting device of the present invention and the device voltage Vf and between the device current If and the device voltage Vf which have been measured using the vacuum processing device shown in FIG. 3. In FIG. 7, the emission current Ie is remarkably small compared with the device current If, thus shown in arbitrary units. Incidentally, the vertical axis and the horizontal axis are scaled linearly.

As being obvious from FIG. 7, the electron-emitting device of the present invention comprises three characteristic referred to the emission current Ie.

That is, (i) With the present device to which a device voltage not less than a certain voltage (Vth called threshold value voltage in FIG. 7) is applied, the emission current Ie increases rapidly, and on the other hand, for a voltage not more than the threshold value voltage Vth, the emission current Ie is scarcely detected.

In other words, the device is a non-linear device having an obvious threshold value voltage Vth toward the emission current Ie.

(ii) Since the emission current Ie depends on the device voltage Vf in monotonous increasing, the emission current Ie can be controlled with the device voltage Vf.

(iii) The quantity of emission electrons captured by the anode electrode 34 depends on time during which the device voltage Vf is applied. That is, the quantity of electrons captured by the anode electrode 34 can be controlled by time during which the device voltage Vf is applied.

As being understandable from the description so far, the electron-emitting device of the present invention will be able to control its electron emission feature easily in accordance with the input signal. When this nature is utilized, applications to various purposes such as electron sources and image forming apparatus, etc., which are configured to comprise a plurality of electron-emitting devices to be disposed, are possible.

FIG. 7 shows an example where the device current If increases in monotonous basis toward the device voltage Vf (hereinafter to be referred to as "MI feature").

In addition, the electron-emitting device of the present invention not only takes shape of the aforementioned planar type configuration as shown in FIGS. 1A to 1C, but also can take configuration of vertical type as described below.

Figure 21:
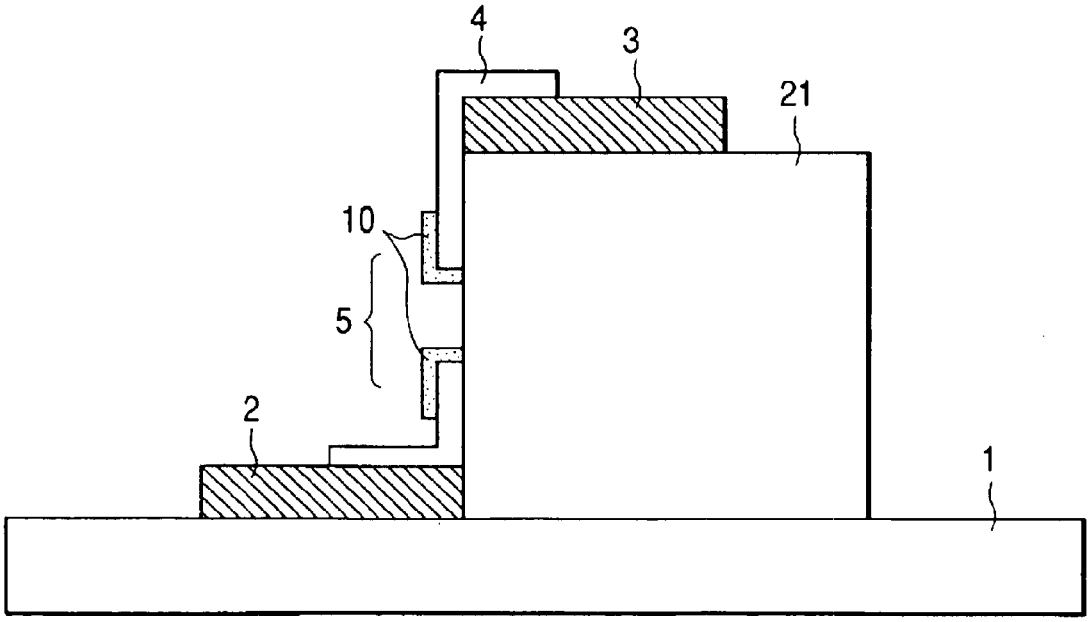
FIG. 21 is a schematic diagram showing another mode of electron-emitting device of the present invention.

FIG. 21 is a schematic diagram drawing showing one example of a vertical type surface conduction type electron-emitting device to which the electron-emitting device of the present invention can be applied.

In FIG. 21, for the same portions as those shown in FIGS. 1A to 1C, the same numbers are applied in correspondence with the numbers indicated in FIGS. 1A to 1C. A step forming portion is numbered as 21. The substrate 1, the device electrodes 2 and 3, the conductive film 4, the electron emission portion 5 can be configured by the materials similar to those in the case of the aforementioned planar type electron-emitting device. The step forming portion 21 can be configured by insulating materials such as $SiO_2$, etc. which have been formed by vacuum evaporation method, printing method, and sputtering method, etc. The film thickness of the step forming portion 21 corresponds with the electrode interval L of the aforementioned planar type surface conduction type electron-emitting device, and can fall within the range of several thousand Å to several ten $\mu$m (micro meter). This film thickness is set considering producing method of the step forming portion and the voltage to be applied to between the device electrodes, but the range from several hundred Å to several micro meter is preferable.

The conductive film 4 is laminated upon the electrodes 2 and 3 after the device electrodes 2 and 3 and the step forming portion 21 have been formed. The electron emission portion 5 is formed on the side wall surface of the step forming portion 21 in FIG. 21, but depends on producing conditions, and forming conditions, etc., and thus the shape and the positions will not be limited to this.

In the vertical type as well, similarly to the planar type, the film comprising carbon 10 has an orientation as shown in FIGS. 1C, 18A, 18B, 19A and 19B. The difference with the planar type is in only the point that the reference of its orientation is the substrate 1 for the planar type, and is the step forming member 21 for the vertical type. The vertical type can be caused to occupy a smaller area for the device itself toward the substrate compared with the planar type, thus can be more highly densely arranged and formed. Also in the case of the vertical type, the electron emission characteristic is similar to the electron emission characteristic of the aforementioned planar type.

Utilizing the features of the above-described electron-emitting device of the present invention, it is possible to form an electron source in which a plurality of the above-described electron-emitting devices are disposed on the substrate. In addition, various kinds of arrangement for electron-emitting devices are adopted. As an example, one involves a ladder-shaped disposition wherein a number of electron-emitting devices disposed in parallel are respectively connected at both ends each other and a number of lines of electron-emitting devices are disposed (called a line direction), and to the direction perpendicular with this wiring (called column direction) the controlling electrode (also called a grid) disposed upper the electron-emitting devices controls and drives electrons from the electron-emitting device. Other than this, nominated is the one wherein a plurality of electron-emitting devices are disposed in the X direction and the Y direction in a matrix shape, and one party of electrodes of a plurality of electron-emitting devices disposed in the same line are commonly connected to the wiring of the X direction, and the other party of electrodes of a plurality of electron-emitting devices disposed in the same column are commonly connected to the wiring of the Y direction. The one like this is so called matrix formation. Firstly, the simple matrix formation will be described.

The surface conduction type electron-emitting device of the present invention has the features (i) through (iii) as aforementioned. That is, the emission electrons from the surface conduction type electron-emitting device can be controlled with the wave height value and width of the pulse-shaped voltage applied between the device electrodes facing each other for a voltage not less than the threshold voltage. On the other hand, for a voltage not more than the threshold voltage, emission will scarcely take place. According to this feature, also in the case where a number of electron-emitting devices are disposed, appropriate application of pulse-shaped voltage to respective devices can control the quantity of electron emission by selecting the surface conduction type electron-emitting devices in accordance with the input signals.

Figure 8:
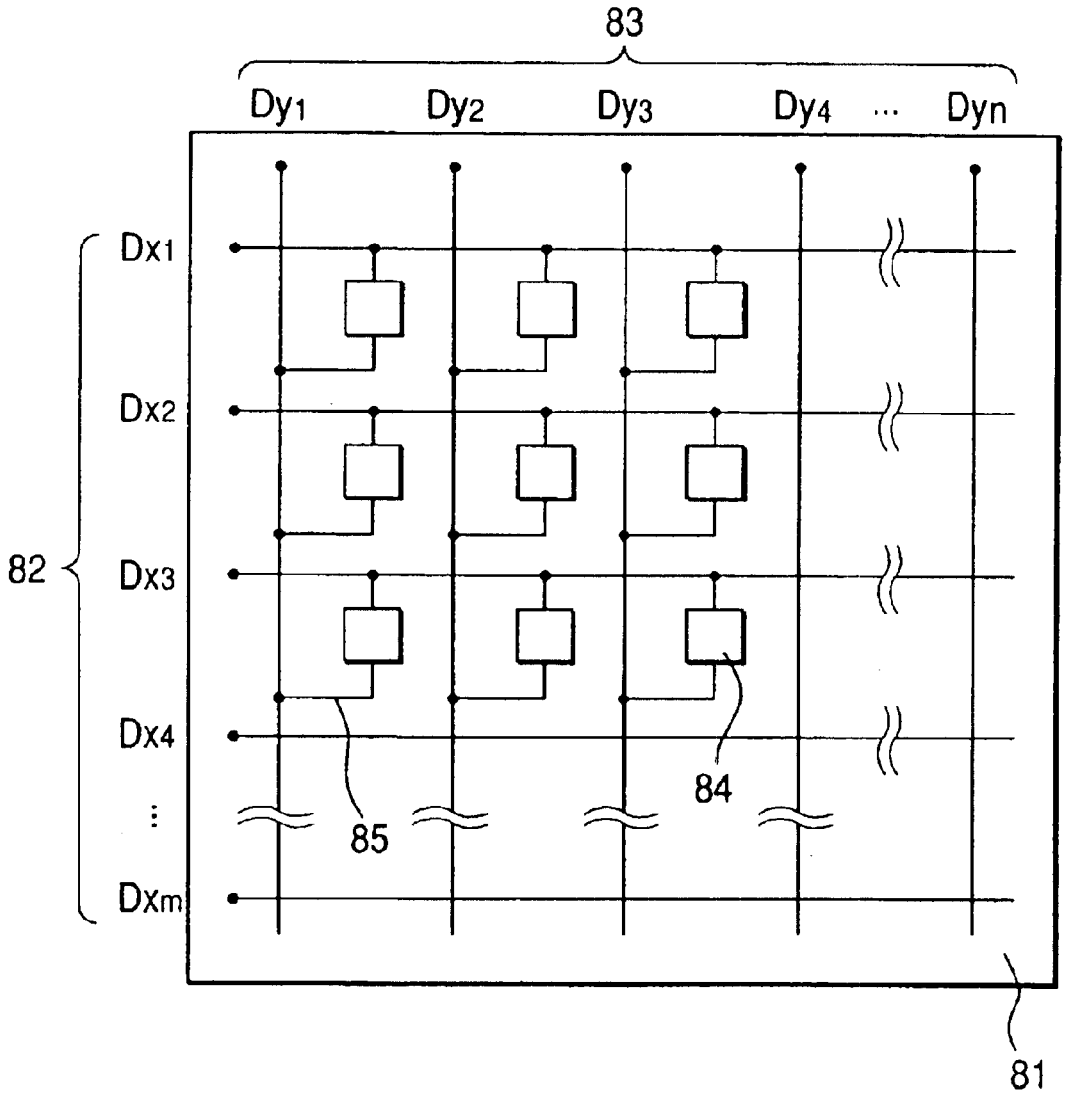
FIG. 8 is a schematic diagram showing an example in which electron-emitting devices of the present invention have been applied to the electron sources disposed in a matrix formation.

Based on this principle, an electron source substrate obtainable by disposing a plurality of electron-emitting devices to which the present invention is applicable is described as follows using FIG. 8. In FIG. 8, a substrate is numbered as 1, wiring in the X direction is numbered as 82, and wiring in the Y direction is numbered as 83. The surface conduction type electron-emitting device is numbered as 84, and wiring knot is numbered as 85.

X direction wiring 82 in m units consists of $D_{x1}$, $D_{x2}$, . . . , $D_{xm}$, and can be configured by conductive metal formed by using vacuum evaporation method, printing method, and sputtering method, etc. and the like.

Materials for wiring, film thickness, and width are appropriately designed. Y direction wiring 83 consists of wiring of n units, namely $D_{y1}$, $D_{y2}$, . . . , and $D_{yn}$, and is formed similarly to X direction wiring 82. Not-shown inter-layer insulation layer is provided between these m units of X direction wiring 82 and n units of Y direction wiring 83 to electrically separate the both parties.

The not-shown insulation layer is configured by $SiO_2$ formed by using vacuum evaporation method, printing method, and sputtering method, etc. and the like. For example, the layer is formed into a desired shape on the entire surface or on a portion of the substrate 1 having formed X direction wiring 82, and film thickness, material, and, producing method are appropriately set so that especially the layer can tolerate the potential at the intersection between X direction wiring 82 and Y direction wiring 83. X direction wiring 82 and Y direction wiring 83 have been respectively pulled out as external terminals.

A pair of electrodes (not shown) configuring the surface conduction type electron-emitting device 84 are electrically connected with m units of X direction wiring 82, n units of Y direction wiring 83, and the wiring knot 85 made of metal, etc.

As for materials configuring wiring 82 and wiring 83, materials configuring the wiring knot 85 and materials configuring a pair of device electrodes, a part or the whole of the component elements thereof may be common or may be respectively different. These materials are appropriately selected from for example materials of the aforementioned device electrode. In the case where materials configuring the device electrode and materials of wiring are the same, wiring connected with a device electrode can be called as a device electrode.

X direction wiring 82 is connected with the not shown scanning signal application means which applies the scanning signal to select lines of surface conduction type electron-emitting devices 84 arranged in the X direction. On the other hand, Y direction wiring 83 is connected with not-shown modulated signal generating means to modulate each column of the surface conduction type electron-emitting devices 84 arranged in the Y direction in accordance with the input signals The driving voltage which is applied to each electron-emitting device is supplied as differential voltage between the scanning signal and the modulated signal to be applied to the element.

In the above-described configuration, simple matrix wiring is used to enable respective devices to be selected independently and to drive independently.

Figure 11:
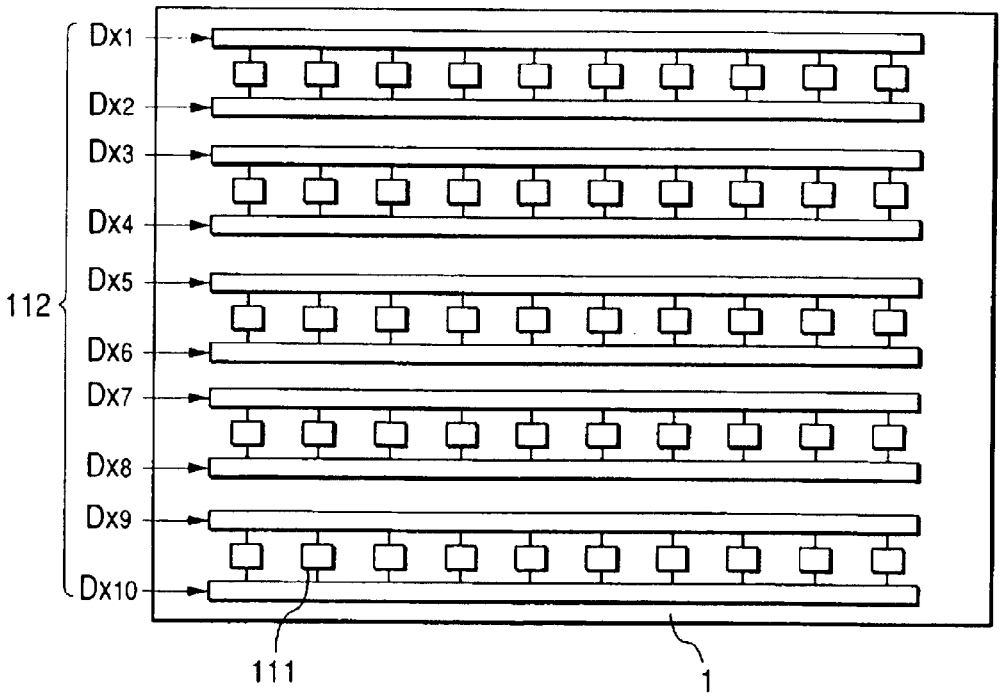
FIG. 11 is a schematic diagram showing an example in which electron-emitting devices of the present invention have been applied to the electron sources disposed in a ladder formation.

Next, electron source of ladder-shaped formation is described using FIG. 11.

FIG. 11 is a schematic diagram drawing showing one example of electron source of ladder-shaped formation. In FIG. 11, an electron source substrate is numbered as 1 and the electron-emitting device is numbered as 111. The common wiring $D_{x1}$ through $D_{x10}$ to connect the electron-emitting devices 111 is numbered as 112. A plurality of the electron-emitting devices 111 are disposed in parallel in the X direction on the substrate 1 (this is called an element line). A plurality of these device lines are disposed to configure an electron source. Application of driving voltage to between common wiring for each device line can cause each device line to be driven independently. That is, to device lines from which electron beam is desired to be emitted a voltage not less than the electron emission threshold value is applied, and to device lines from which electron beam is not emitted a voltage not more than the electron emission threshold value is applied. For the common wiring $D_{x2}$ through $D_{x9}$ between each device line the same wiring can be adopted for $D_{x2}$ and $D_{x3}$, for example.

The manufacturing method of the present invention can be applied to any of the electron source based on the above-described methods.

Figure 6A:
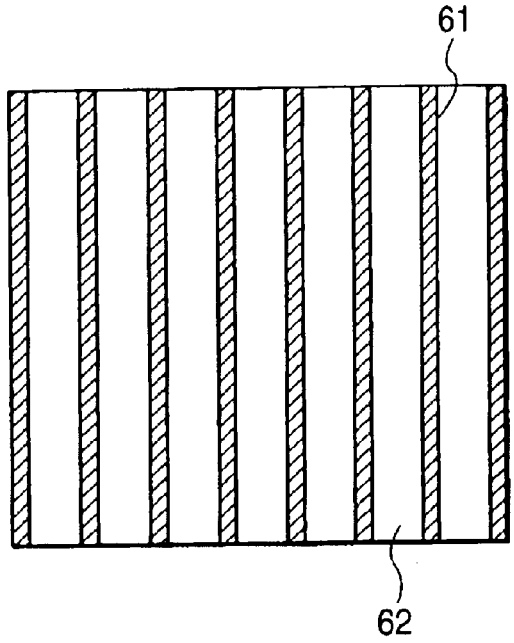
FIGS. 6A and 6B are schematic diagrams showing an example of fluorescent film.
Figure 6B:
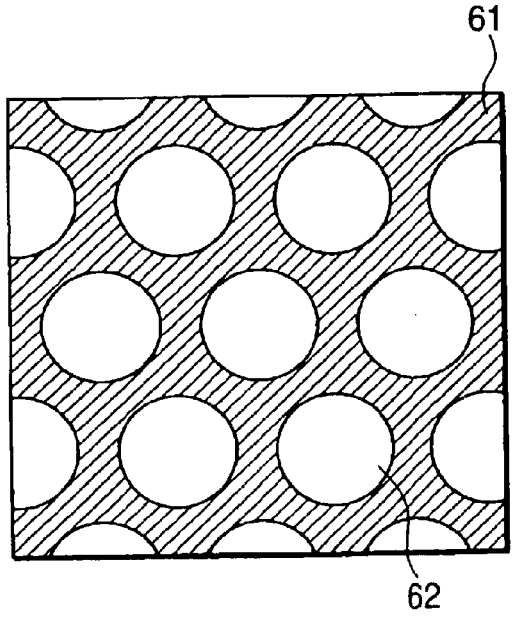
Figure 9:
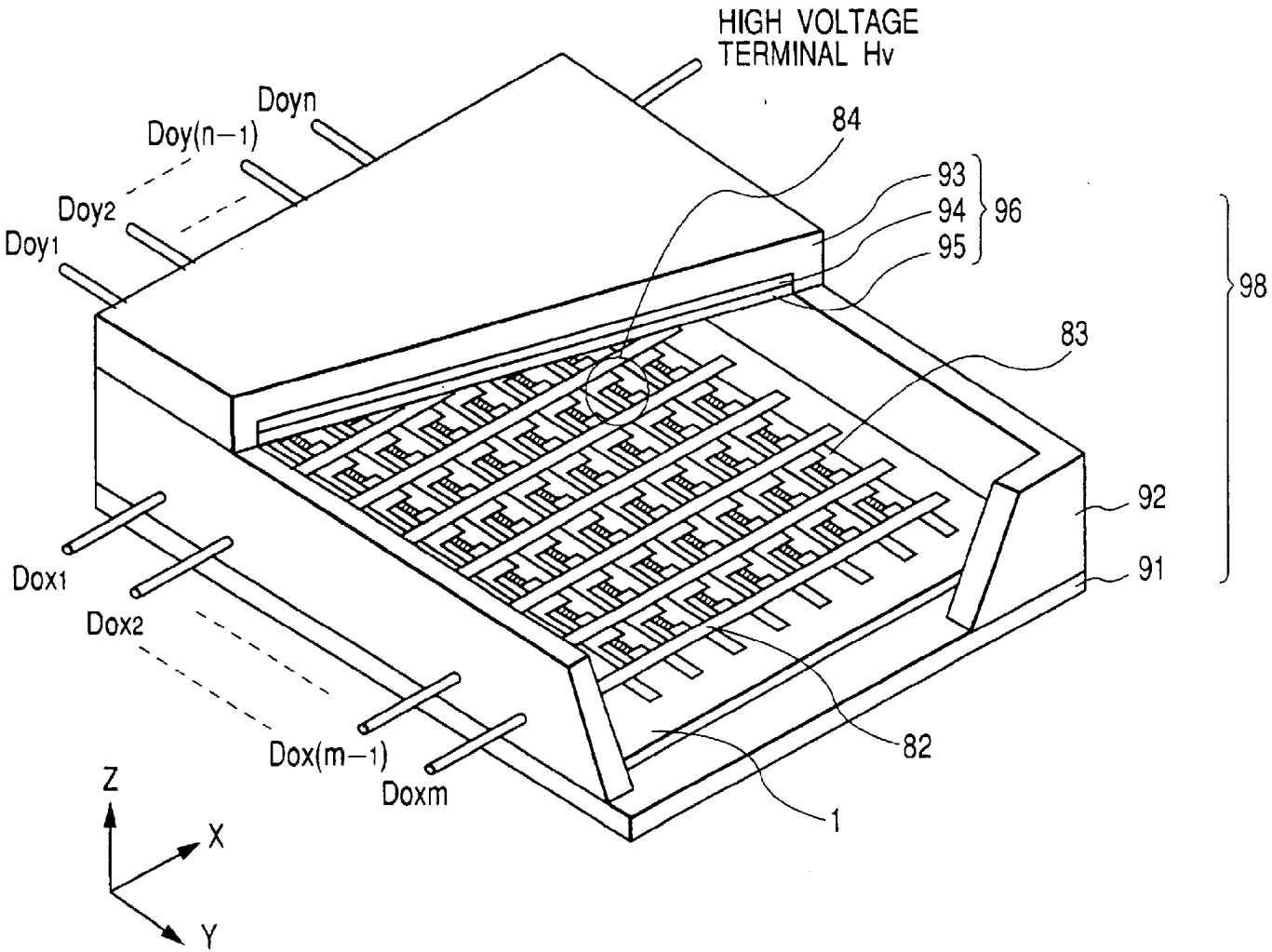
FIG. 9 is a schematic diagram showing an example in which an electron-emitting device of the present invention has been applied to an image forming apparatus.

The image forming apparatus which has been configured using an electron source in the above-mentioned simple matrix formation is described using FIGS. 6A, 6B and 9. FIG. 9 is a schematic diagram drawing showing one example of the display panel of an image forming apparatus, and FIGS. 6A and 6B are schematic diagram drawings of fluorescent film used for the image forming apparatus in FIG. 9.

In FIG. 9, the electron source substrate in which a plurality of electron-emitting devices are disposed is numbered as 1, a rear plate on which the substrate 1 is fixed is numbered as 91, and the face plate in which fluorescent film 94 and metal back 95, etc. are formed inside the glass substrate 93 is numbered 96. A supporting frame is numbered as 92 and to the supporting frame 92 a rear plate 91 and face plate 96 undergo junction using flit glass with low melting point and the like.

The electron-emitting device of the present invention is numbered as 84. The X direction wiring and the Y direction wiring connected with a pair of device electrodes configuring the electron-emitting device of the present invention are respectively numbered as 82 and 83.

The enclosure (vacuum container) 98 is configured by a face plate 96, a supporting frame 92 and a rear plate 91 as described above. Since the rear plate 91 is provided mainly for the purpose of reinforcing strength of the substrate 1, thus when the substrate 1 itself has sufficient strength, a rear plate 91 as a separate body can be regarded unnecessary. That is, the supporting frame 92 is directly sealed to the substrate 1 and the exterior enclosure 98 may be configured with the face plate 96, the supporting frame 92 and the substrate 1. On the other hand, a not-shown supporting member called a spacer can be disposed between the face plate 96 and the rear plate 92 to configure the enclosure 98 with sufficient strength against the atmosphere pressure.

FIGS. 6A and 6B are schematic diagram drawings showing a fluorescent film 94. The fluorescent film 94 can be configured by only fluorescent body in the monochrome case. In the case of color fluorescent film, the film can be configured by black conductive members 61 called black stripe or black matrix, etc. due to the arrangement of fluorescent body and fluorescent body 62. The purpose to provide a black stripe and a black matrix is to lessen color mixture, etc. to an unnoticeable level by blackening the portions adjacent portions outside each fluorescent body 62 to which necessary three basic color fluorescent bodies are allocated in the case of color display, and to control decrease in contrast due to reflection of outer lights in the fluorescent film 94. For the black stripe material, other than the material involving normally used graphite as a main component, materials which has conductivity, and less transparency and reflection of lights can be used. The method to supply fluorescent body to a glass substrate 93 is not limited to monochrome or color, and precipitation method and print processes, etc. can be adopted. Metal back 95 is normally provided on the interior surface of the fluorescent film 94. The purpose to provide a metal back is to improve brightness by causing lights toward the interior surface from radiation of the fluorescent body to mirror-reflect to direction of the face plate 96, and to cause to act as electrode to apply electron beam acceleration voltage, and to protect the fluorescent body against damage due to bombering of negative ions generated inside the exterior enclosure and the like. The metal back can be formed by implementing smoothing processing on the surface of interior surface of the fluorescent film (normally called "filming") after the fluorescent film is formed, and thereafter depositing Al using vacuum evaporation method, etc.

The face plate 96 may be provided with a transparent electrode (not shown) to the exterior party of the fluorescent film 94 to further improve conductivity of the fluorescent film 94.

When the aforementioned sealing is implemented, in the color case, each color fluorescent body is required to correspond with the electron-emitting device, and sufficient positioning is implemented.

One example of manufacturing method of an image forming apparatus shown in FIG. 9 is described below. Up to the step of activation of each electron-emitting device configuring the electron source, the methods having already been described are implemented. Thereafter, the stabilization step is implemented, and then the electron source, image forming members, vacuum container forming members, etc. are bonding each other with flit glass, etc., thereby assembly step is implemented, and the interior gas is removed and the exhaust tube is heated by a burner, etc. and sealed out. After this, according to necessity, getter processing is implemented. Alternatively, after the assembly step is implemented, the forming step, activation step, and stabilization step may be implemented.

Figure 10:
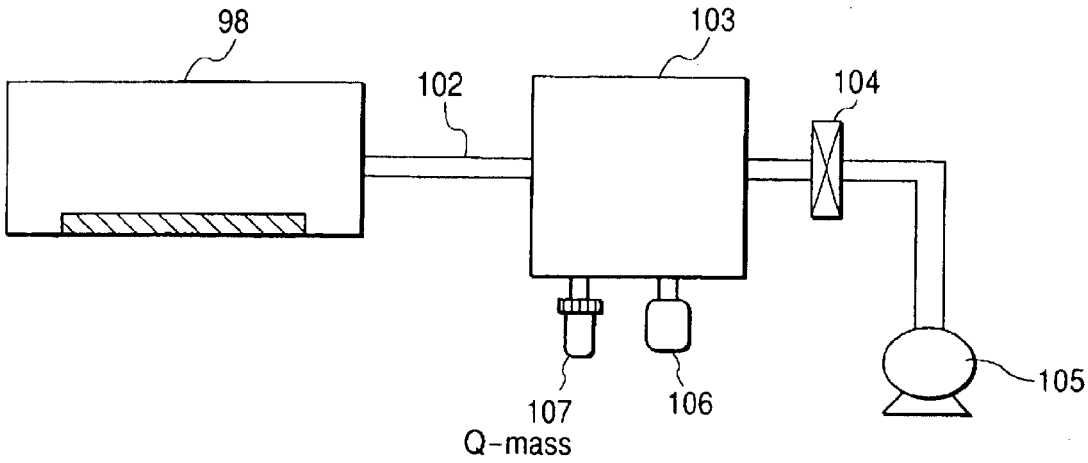
FIG. 10 is a schematic diagram showing an example of a vacuum processing system being used in the manufacturing step of an image forming apparatus at the time when an electron-emitting device of the present invention has been applied to the image forming apparatus.

FIG. 10 is a schematic diagram drawing showing outline of the device to be used in the step after especially the enclosure has been assembled. The enclosure 98 is connected to the vacuum chamber 103 via ventilation tube 102, and moreover, is connected with the evacuation apparatus 105 via the gate valve 104. To the vacuum chamber 103, a pressure measure 106 and quadrupole mass spectrograph 107, etc. are attached for the purpose of measuring the interior pressure as well as the pressure allocated to each component in the atmosphere. Since it is difficult to measure the interior pressure of the enclosure 98, etc. directly, the pressure inside the vacuum chamber 103, etc. are measured.

The aforementioned stabilization step and the sealing step are implemented, for example, by heating the enclosure 98 to maintain an appropriate temperature of 80 to 300° C., and implementing evacuation through the exhaust tube 102 by the evacuation apparatus 105 without using oil such as ion pump and absorption pump, etc. to sufficiently lessen organic substances from the atmosphere, and by confirming this with the pressure meter 106 and quadrupole mass spectrograph 107, and thereafter heating the exhaust tube with a burner to melt, and sealing out the device.

Preferably, for the purpose of maintaining the pressure after sealing of the enclosure 98, getter processing is implemented. In the case where evaporation-type getter is used, just before or after the enclosure 98 is sealed, the getter disposed in the predetermined position (not shown) inside the enclosure 98 is heated by using resistance heating or high frequency heating, etc. and the evaporation film is formed.

Figure 12:
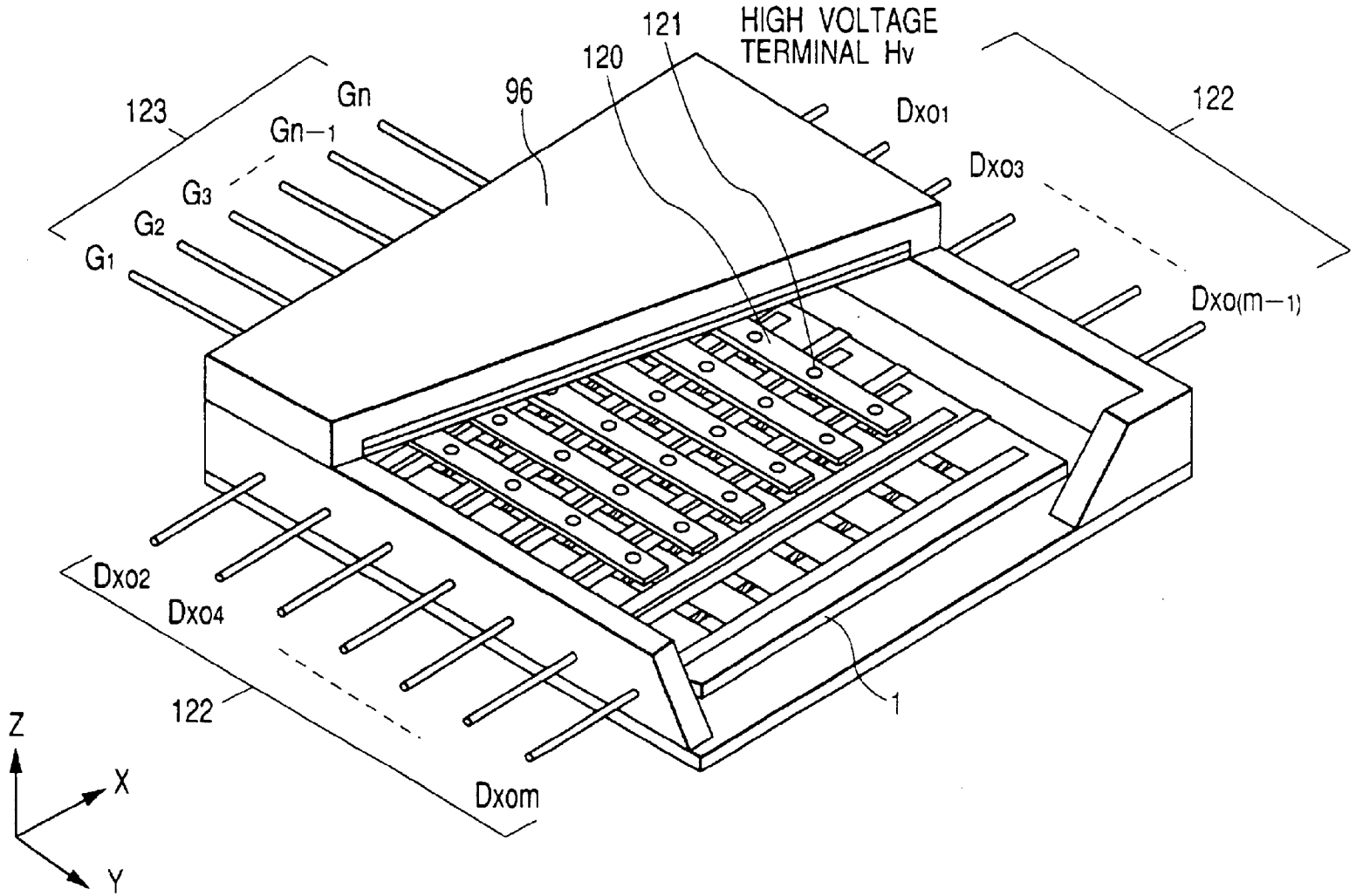
FIG. 12 is a schematic diagram showing another example in which an electron-emitting device of the present invention has been applied to an image forming apparatus.

FIG. 12 is a schematic diagram drawing showing one example of a panel configuration in an image forming apparatus comprising an electron source in the ladder-shaped formation. The grid electrode is numbered as 120, the cavity for electron to come through is numbered as 121, and the terminals outside the container consisting of $D_{ox1}$, $D_{ox2}$, . . . $D_{oxm}$ are numbered as 122. The terminals outside the container consisting of $G_1$, $G_2$, . . . $G_n$ which are connected with the grid electrode 120 are numbered as 123.

The big difference between the image forming apparatus shown here and the image forming apparatus in a simple matrix formation shown in FIG. 11 is whether or not the device comprises the grid electrode 120 between the electron source and the face plate.

The grid electrode 120 is the one to modulate the electron beam emitted from the surface conduction type electron-emitting device, and for the purpose of causing the electron beam to pass through the stripe-shaped electrodes disposed in perpendicular with the device lines in a ladder-shaped formation, one circular opening 121 each corresponding to each device is provided. The shape and the disposing position of the grid will not be limited to the one shown in FIG. 12. For example, as an opening, a number of passing-through openings can be provided in a meshed formation, and the grid can be provided surrounding or in the vicinity of the surface conduction type electron-emitting device.

The terminals outside the container 122 and the terminals outside the grid container 123 are electrically connected with the not-shown controlling circuit.

Accordingly, the producing method of the image forming apparatus using the electron source having a ladder-shaped wiring is almost similar to that in the case of the image forming apparatus in the aforementioned simple matrix formation.

EXAMPLE 1

The electron-emitting device formed by the present example is configured as schematically shown in FIGS. 1A and 1B.

The manufacturing steps of the electron-emitting device produced in the present example are described using drawings as follows.

Step-a

Quartz has been used as the substrate 1, and after cleaning this with detergent, pure water, and organic solvent, the photoresist RD-2000N (produced by Hitachi Chemical Co., Ltd.) has been applied with spinner (2500 rpm for 40 seconds), and pre-baking has been implemented at 80° C. for 25 minutes.

Next, using a mask corresponding to the device electrode pattern, contact exposure has been implemented, and developing using developer has been implemented, and post-baking at 120° C. for 20 minutes has been implemented and thus the resist mask has been formed.

Next, Ni has been film-formed with the vacuum evaporation method. The film-forming rate has been 0.3 mm/second with film thickness being 10 nm.

Next, the above-described substrate has been dipped in acetone to melt the resist mask, and then the element electrodes 2 and 3 of Ni have been formed by lift-off. The electrode interval H is 2 $\mu$m, and the electrode length W is 500 $\mu$m. (FIG. 2A)

Step-b

Next, Cr has been film-formed so as to have 50 nm thickness with the vacuum evaporation method after cleaning with aceton, isopropanol, butyl acetate the substrate in which electrodes have been formed and drying it. Next, the photoresist AZ1370 (produced by Hoechst Corp.) has been applied with spinner (2500 rpm for 30 seconds), and pre-baking has been implemented at 90° C. for 30 minutes.

Next, with exposure and development using the mask an opening corresponding to the shape of the conductive film has been formed, and post-baking has been implemented at 120° C. for 30 minutes to form resist mask.

Next, the substrate has been dipped into etchant ($(NH_4)Ce(NO_3)_6/HCl/H_2O$=17 g/5 cc/100 cc) for 30 seconds so that the mask opening undergoes Cr etching, and then the resist has been delaminated by acetone to form Cr mask.

Next, the organic Pd compound solution (ccp-4230 produced by Okuno Chemical Industries Co., Ltd.) has been applied with spinner (800 rpm for 30 seconds), and baking has been implemented at 300° C. for 10 minutes to form a conductive film made from PdO.

Next, the substrate has been dipped into the above-described etchant again to remove Cr mask, and by lift-off, a conductive film 4 of the desired pattern has been formed. (FIG. 2B)

Step-c

Next, the above-described device has been mounted on the device schematically shown in FIG. 3, and the gas inside the vacuum chamber 35 has been evacuated with a not-shown evacuation apparatus, and when the pressure has reached not more than $1.3\times10^{-3}$ Pa, the triangular pulses with wave height value being gradually increased as shown in FIG. 4B have been applied to between the electrodes 2 and 3. The pulse width T1 has been set at 1 msec, and the pulse interval T2 has been set at 10 msec. When the wave height value has reached approximately 5.0 V, forming process has been completed and the second gap 6 has been formed. (FIG. 2C)

Step-d

Figure 2D:
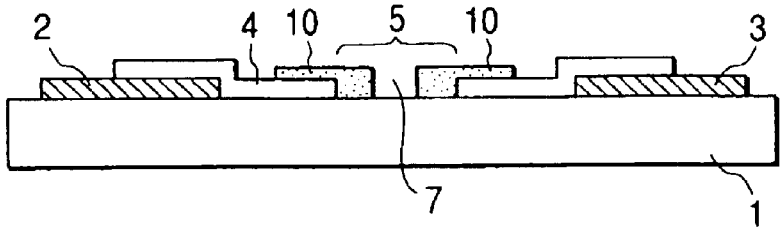
Figure 13A:
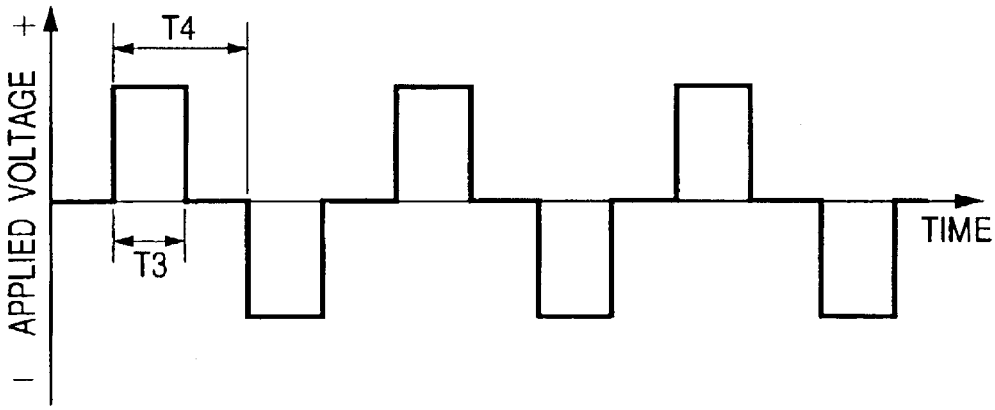
FIGS. 13A and 13B are schematic diagrams showing examples of voltage wave forms available for use in the activation step as a part of the manufacturing step of electron-emitting device of the present invention.
Figure 13B:
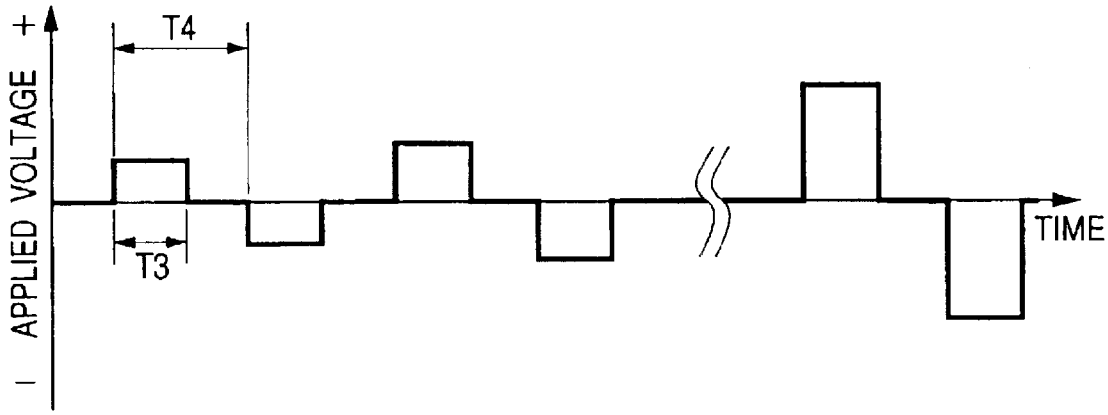

Next, the gas inside the vacuum chamber 35 has been further evacuated with the evacuation apparatus, and after the pressure has reached not more than $1.3\times10^{-5}$ Pas, tolunitrile has been introduced to get the pressure of $1.3\times10^{-4}$ Pa. At first, the rectangular pulses which inverse polarities have been repeatedly applied to between the device electrodes with the wave height value as shown in FIG. 13B being gradually increased. Here, the pulse width T3 has been set at 1 msec., and the pulse interval T4 has been set at 10 msec., and the wave height value has been gradually increased from 10 V to 15 V over 35 minutes. Thereafter, the rectangular pulses as shown in FIG. 13A which inverse polarities with the constant wave height value have been repeatedly applied to between the device electrodes. The wave height value has been set at 15 V, the pulse width T3 has been set at 1 msec., and the pulse interval T4 has been set at 10 msec. The present step has formed the carbon film 10 as well as the first gap 7 as shown in FIG. 2D.

Step-e

Next, the device has been heated to reach 150° C. and maintained thereat while the gas inside the vacuum chamber 35 has been evacuated with the evacuation apparatus, then the pressure has reached $1.3\times10^{-6}$ Pa.

Next, after the device has been returned to the room temperature, a voltage of 8 kV has been applied to the anode electrode 34, and the rectangular pulses with the constant wave height value have been applied to between the device electrodes, and features thereof have been measured. Incidentally, the distance between the anode electrode and the device has been set at 4 mm.

The device of the present example has been driven for a constant time period, and it has been found out that the device currents If and Ie have scarcely been reduced. In addition, the phenomena to be regarded as discharge have never been observed during this driving, and a device extremely stable in terms of electron emission characteristic has been obtained. Moreover, before and after the step e, decrease of film thickness of the carbon film 10 has scarcely been observed, thus it has been shown that the device is also thermally stable.

In addition, using FIB-TEM method, a cross-sectional observation on the form of the electron-emitting device of the example 1 has been implemented. Here, the observation has been implemented with digital recording in use of an imaging plate. At first, the observation has taken place with a low magnification, it has been found out that not only inside the gap 6 in FIGS. 1A to 1C, but also on the conductive film surrounding it the film comprising carbon (carbon film) 10 with thickness of not less than the level of 10 nm has been formed. Next, when the carbon film has been observed at a higher magnification, there have existed portions over a wide range where lattice fringes (lattice image) orientated in the approximately normal direction (<±30°) against the surface of underlining substrate (the substrate 1 or the conductive film 4) have been observed as shown in FIGS. 19A and 19B. Moreover, when the interval of those lattice fringes (lattice image) have been measured, the range has been observed to be from 3.5 to 4.7 Å.

Moreover, when the observation image of the carbon film on the conductive film has undergone Fourier transform to obtain diffraction pattern, there have existed portions over a wide range where diffraction ring having maximum intensity in the approximately normal direction (<±30°) against the surface of underlining substrate (or the conductive film) have been measured. In addition, the interval of the lattice fringes (lattice image) obtained from the distance between the positions with maximum intensity of diffraction ring and the origin point of the diffraction pattern is measured to be in a range of 3.5 to 4.7 Å. In addition, the intensity of the diffraction ring with maximum intensity in a direction has been divided by the intensity of the diffraction ring in the direction perpendicular with the above-mentioned direction to give a ratio which have been measured to be 2.5 or more.

EXAMPLE 2

Figure 14:
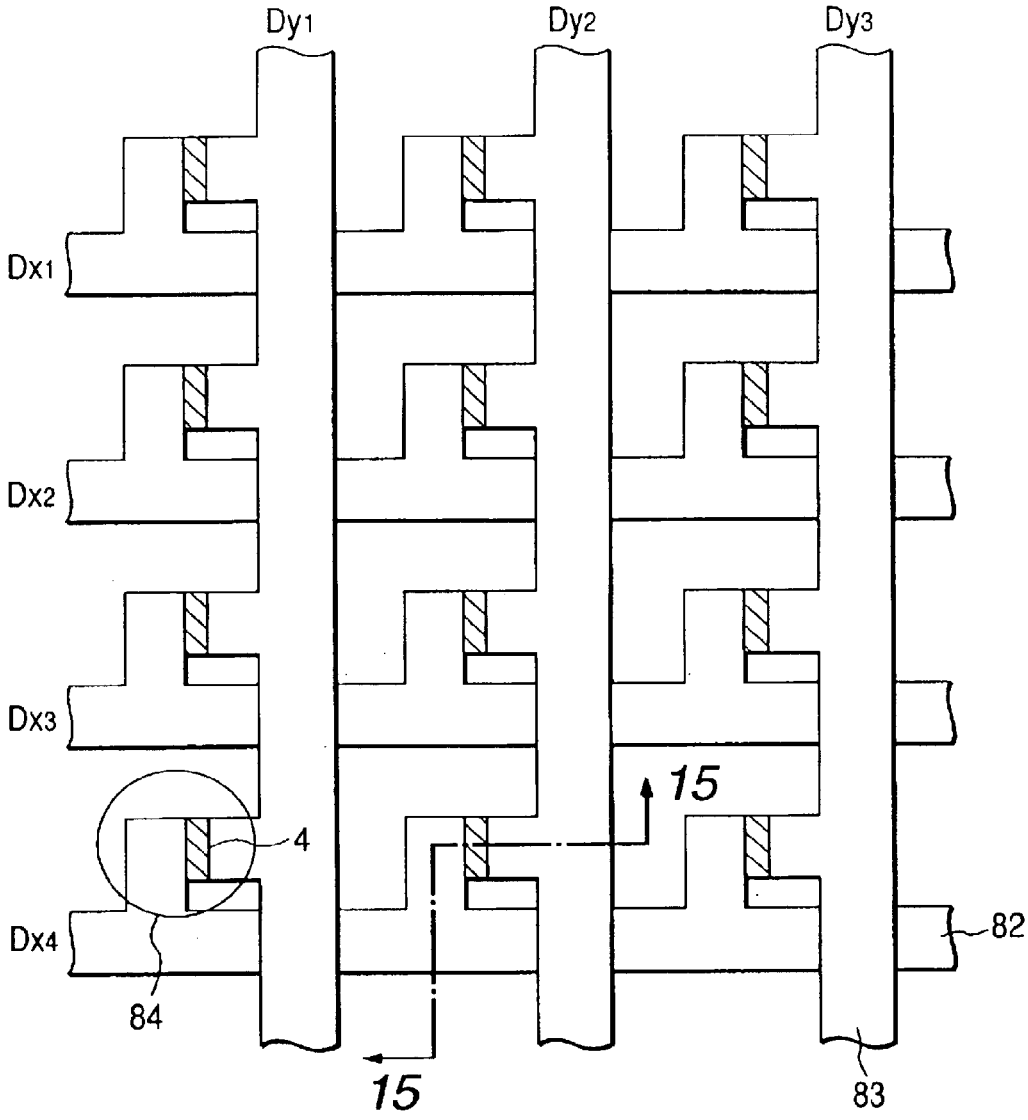
FIG. 14 is a schematic diagram showing an example in which electron-emitting devices of the present invention have been applied to electron sources disposed in a matrix formation.
Figure 15:
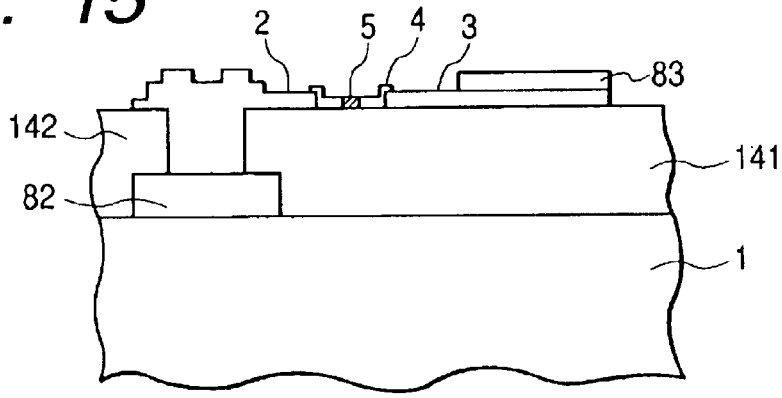
FIG. 15 is a partial sectional schematic diagram along the broken line 15—15 in FIG. 14.

The present example is a manufacturing method of the electron source of the matrix wiring schematically shown in FIG. 14, and of the image forming apparatus (FIG. 9) using this electron source. FIG. 14 is a partial plan view showing as a schematic diagram the configuration of the electron source of the matrix wiring formed by the present example, and the sectional configuration along a polygonal line 15—15 in FIG. 14 is shown in FIG. 15. With reference to FIGS. 16A to 16D and FIGS. 17E to 17G, the manufacturing step of the electron source is described, and moreover the manufacturing step of the image forming apparatus is also described as follows.

Step-A

Figure 16A:
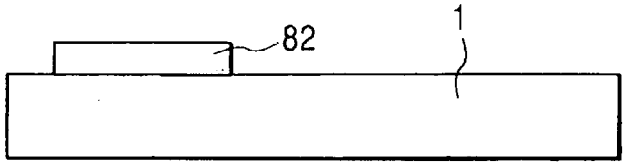
FIGS. 16A, 16B, 16C and 16D are schematic diagrams to describe a part of manufacturing step of an electron-emitting device related to the examples of the present invention.

Silicon oxide film of 0.5 μm has been formed by sputtering method on a blue plate glass which has been cleaned, and the product is treated as the substrate 1, and Cr 5 nm and Au 600 nm have been film-formed thereon by vacuum evaporation method in succession, thereafter, the photoresist AZ1370 (produced by Hoechst Corp.) has been used to form the underlining wiring 82 by photolithography technology. (FIG. 16A)

Step-B

Figure 16B:
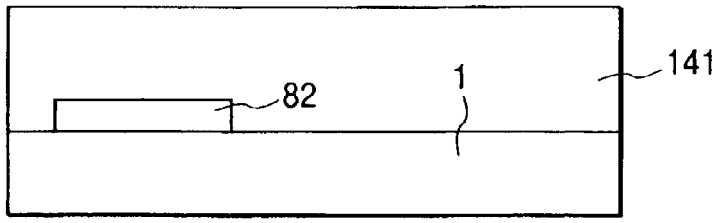

Next, the inter-layer insulation layer 141 made of silicon oxide film with thickness of 1 μm is deposited by sputtering method. (FIG. 16B)

Step-C

Figure 16C:
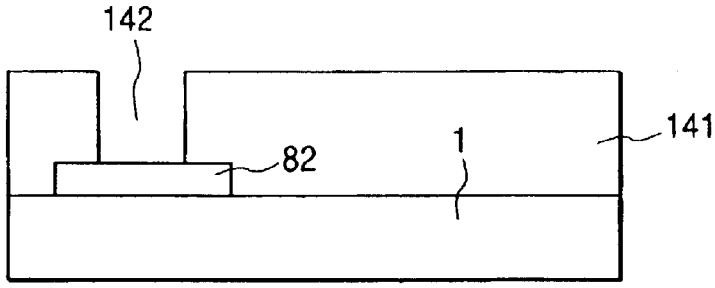

A photoresist pattern to form contract holes 142 in the inter-layer insulation layer is produced, and with this as a mask, the inter-layer insulation layer 141 has undergone etching by RIE (Reactive Ion Etching) method using $CF_4$ and $H_2$. (FIG. 16C)

Step-D

Figure 16D:
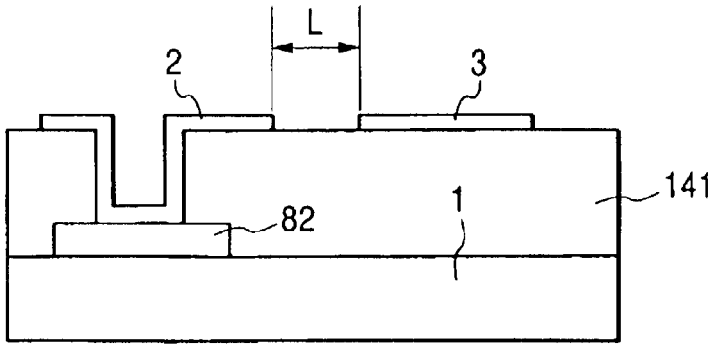

A mask pattern of photoresist (RD-2000N-41: produced by Hitachi Chemical Co., Ltd.) having openings corresponding to the pattern of the device electrode has been formed, and Ti 5 nm and Ni 100 nm have been deposited thereon by vacuum evaporation method in succession, and next, the photoresist has been removed by an effective solvent, and the device electrodes 2 and 3 are formed by lift-off. The interval L between the device electrodes has been set at 3 μm. (FIG. 16D)

Step-E

Figure 17E:
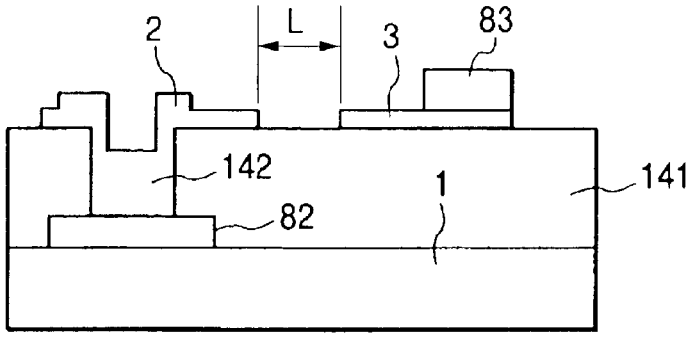
FIGS. 17E, 17F and 17G are schematic diagrams to describe a part of manufacturing step of an electron source related to the examples of the present invention.

The upper wiring 83 having lamination configuration of Ti 5 nm and Au 500 nm has been formed by photolithography method using the photoresist similar to that in the step-A. (FIG. 17E)

Step-F

Figure 17F:
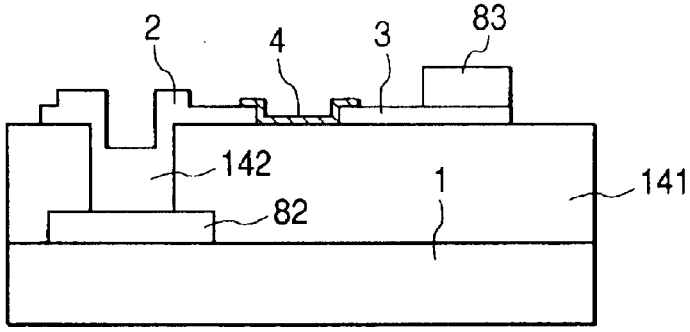

The conductive film 4 made of PdO has been formed by lift-off using the Cr mask similar to that in the step-b of the example 1. (FIG. 17F)

Step-G

Figure 17G:
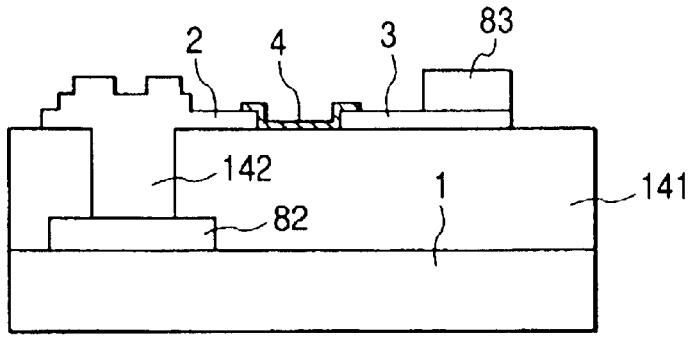

The resist pattern covering other than the contact holes 142 has been formed, Ti 5 nm and Au 500 nm have been deposited in succession by vacuum evaporation, the resist pattern has been removed, unnecessary laminated film has been removed and the contact holes have been filled in, and the electron source substrate prior to forming has been produced. (FIG. 17G)

Using the above-described electron source substrate, the image forming apparatus having configuration shown in FIG. 9 has been produced.

The substrate 1 of the electron source has been fixed in the rear plate 91, and the face plate 96 has been disposed upper 5 mm of the substrate via the supporting frame 92, and flit glass has been applied on the bonding portions, and the temperature has been maintained at 400° C. for 10 minutes in nitrogen atmosphere and bonding has been implemented to form the enclosure 98. The fluorescent film 94 and the metal back 95 have been formed on the interior surface of the face plate. The fluorescent film 94 shaped stripe (FIG. 6A) has been adopted and formed by print processes. For the black conductive member, quality of the material comprising graphite as a main component has been used. The metal back has been formed by vacuum-evaporating Al after smoothing processing (filming) has been implemented on the interior surface of the fluorescent film.

At the time when the above-described assembly is implemented, it is necessary to proceed with corresponding to the fluorescent body and the electron-emitting device accurately, and the positioning has been conducted sufficiently. Incidentally, to inside the exterior enclosure, a getter (not shown) is also attached.

Step-H

The gas inside the above-mentioned enclosure has been evacuated with the not-shown evacuation apparatus (vaccum pomp), and the triangular wave pulses have been applied similar to the step c of the example 1 to implement the forming step and the second gap 6 has been formed in each conductive film.

Step-I

In succession, tolunitrile has been introduced into the exterior enclosure similar to the step d of the example 1 to implement the activation step.

Step-J

Next, similarly to the step e of the example 1, while the interior of the exterior enclosure has been undergoing evacuation, it has been heated and the stabilization step has been implemented, and as a result, the interior pressure has reached $1.3\times10^{-6}$ Pa in approximately three hours.

Not-shown driving circuit has been attached to the exterior enclosure produced by the steps mentioned so far, and a high voltage of 10 kV has been applied to the metal back and the TV signals have been inputted to cause images to be displayed, then no phenomena regarded as discharge have not taken place, highly bright and highly minute images have been obtained on stable basis over a long time period.

EXAMPLE 3

The electron-emitting device has been formed in steps similar to those in the example 1 except that the step-d of the example 1 has been changed to the step-D2 as shown below.

Step-D2

Next, the gas inside the vacuum chamber 35 has been evacuated by the evacuation apparatus 36, and after the pressure reach not more than $1.3\times10^{-5}$ Pa, acrylonitrile has been introduced and the pressure has been set at $1.3\times10^{-3}$ Pa. At first, the rectangular wave pulses which invert polarity while gradually increasing the wave height value as shown in FIG. 13B have been repeatedly applied to between the device electrodes. Here, the pulse width T3 has been set at 1 msec. and the pulse interval T4 has been set at 10 msec., and the wave height value has been gradually increased from 10 V to 15 V over 35 minutes. At that time, when the pulse voltage has not been applied to between the device electrodes, an electron beam has been radiated as pulses to the devices from the electron gun (not shown). Thereafter, the rectangular wave pulses which invert polarity at a constant wave height value as shown in FIG. 13A have been repeatedly applied to between the device electrodes. The wave height value has been set at 15 V, and the pulse width T3 has been set at 1 msec. and the pulse interval T4 has been set at 10 msec. At that time, when the pulse voltage has not been applied to between the device electrodes, an electron beam has been radiated as pulses to the devices from the electron gun (not shown). In the present example, the activation step has been implemented while the electron beams are radiated to the carbon film.

The device of the present example has shown stable electron emission characteristic for a longer time period compared with the device of the example 1. Moreover, the film comprising carbon has been evaluated using evaluation method similar to that in the example 1, then lattice fringes (lattice image) orientated in the approximately normal direction against the surface of the substrate have been obviously observed over a wide range.

EXAMPLE 4

The electron-emitting device having formed by the present invention is configured as schematically shown in FIGS. 1A and 1B.

The producing steps of the electron-emitting device having been produced in the present invention are described using drawings as follows.

Step-a

Quartz has been used as the substrate 1, and after cleaning this with detergent, pure water, and organic solvent, the photoresist RD-2000N (produced by Hitachi Chemical Co., Ltd.) has been applied with spinner (2500 rpm for 40 seconds), and pre-baking has been implemented at 80° C. for 25 minutes.

Next, using a mask corresponding to the element electrodes 2 and 3 pattern, contact exposure has been implemented, and developing using developer has been implemented, and post-baking at 120° C. for 20 minutes has been implemented and thus the resist mask has been formed.

Next, Ni has been film-formed with the vacuum evaporation method. The film-forming rate has been 0.3 mm/second with film thickness being 10 nm.

Next, the above-described substrate has been dipped in acetone to melt the resist mask, and then the device electrodes 2 and 3 of Ni have been formed by lift-off. The electrode interval L is 2 $\mu$m, and the electrode length W is 500 $\mu$m. (FIG. 2A)

Step-b

Next, Cr has been film-formed so as to have 50 nm thickness with the vacuum evaporation method after cleaning with acetone, isopropanol, and butyl acetate the substrate in which electrodes have been formed and drying it. Next, the photoresist AZ1370 (produced by Hoechst Corp.) has been applied with spinner (2500 rpm for 30 seconds), and pre-baking has been implemented at 90° C. for 30 minutes.

Next, with exposure and development using the mask an opening corresponding to the shape of the conductive film 4 has been formed, and post-baking has been implemented at 120° C. for 30 minutes to form resist mask.

Next, the substrate has been dipped into etchant ($(NH_4)Ce(NO_3)_6/HCl/H_2O$=17 g/5 cc/100 cc) for 30 seconds so that the mask opening undergoes Cr etching, and next the resist has been delaminated by acetone to form Cr mask.

Next, the organic Pd compound solution (ccp-4230 produced by Okuno Chemical Industries Co., Ltd.) has been applied with spinner (800 rpm for 30 seconds), and baking has been implemented at 300° C. for 10 minutes to form a conductive film made from small particles of PdO.

Next, the substrate has been dipped into the above-described etchant again to remove Cr mask, and by lift-off, a conductive film 4 of the desired pattern has been formed. (FIG. 2B)

Step-c (Forming Step)

Next, the above-described device has been mounted on the apparatus schematically shown in FIG. 3, and the gas inside the vacuum chamber 35 has been evacuated with the evacuation apparatus 36, and when the pressure has reached not more than $1.3\times10^{-3}$ Pa, the triangular pulses with wave height value being gradually increased as shown in FIG. 4B have been applied to between the electrodes 2 and 3. The pulse width T1 has been set at 1 msec, and the pulse interval T2 has been set at 10 msec. When the wave height value has reached approximately 5.0 V, forming step has been completed and the second gap 6 has been formed. (FIG. 2C)

Step-d (Activation step)

Next, while the gas inside the vacuum chamber 35 has been being evacuated with the evacuation apparatus 36, the vacuum chamber 35 and the elements having finished undergoing the forming step have undergone baking at 150° C. for two hours. And, when the temperature has dropped to the room temperature, the pressure inside the vacuum chamber 35 has reached nor more than $1.3\times10^{-6}$ Pa.

Thereafter, tolunitrile has been introduced to inside the vacuum chamber 35 until the pressure has reached $1.3\times10^{-6}$ Pa, which has been maintained for one hour until the pressure has been stabilized, and thereafter, the rectangular pulses which invert polarity have been applied to between the device electrodes 2 and 3 with the wave height value as shown in FIG. 13B being gradually increased. Here, the pulse width T3 has been set at 1 msec. and the pulse interval T4 has been set at 10 msec., and the wave height value has been gradually increased from 10 V to 15 V over 35 minutes. Thereafter, the rectangular wave pulses which invert polarity at a constant wave height value as shown in FIG. 13A have been repeatedly applied to between the element electrodes 2 and 3. The wave height value has been set at 15 V, and the pulse width T3 has been set at 1 msec. and the pulse interval T4 has been set at 10 msec. The present step has formed the carbon film 10 on the substrate 1 inside the second gap 6 formed in the above-described forming step as well as on the conductive film 4 in the vicinity of the second gap 6 (FIG. 2D). In addition, at the same time the first gap 7 has been formed.

Step-e

Next, the device has been heated to reach 150° C. and maintained thereat while inside the vacuum chamber 35 has been evacuated, then the pressure inside the vacuum chamber 35 has reached $1.3\times10^{-6}$ Pa.

Next, after the device has been returned to the room temperature, a voltage of 8 kV has been applied to the anode electrode 34, and the rectangular pulses with the constant wave height value have been applied to between the electrodes 2 and 3, and features thereof have been measured. Incidentally, the distance between the anode electrode and the device has been set at 4 mm.

The device of the present example has been driven for a constant time period, and it has been found out that the device currents If and Ie have scarcely been reduced. In addition, the phenomena to be regarded as discharge have never been observed during this driving, and a device extremely stable in terms of electron emission characteristic has been obtained. Moreover, before and after the step e, decrease of film thickness of the film comprising carbon (carbon film) 10 has scarcely been observed, thus it has been shown that the device is also thermally stable.

Next, using FIB-TEM method, a cross-sectional observation on the form in the step where the activation step of the present example has been finished has been implemented. Here, the observation has been implemented with digital recording in use of an imaging plate. At first, the observation has taken place with a low magnification, it has been found out there exist portions where not only inside the gap 6 in FIGS. 1A to 1C but also on the conductive film 4 surrounding it the film comprising carbon 10 with thickness of not less than the level of 10 nm has been formed. Moreover, it has been confirmed that the carbon films 10 are facing each other having the first gap 7, width of which is narrower than the second gap 6, inside the second gap 6 between them. Next, the deposits have been observed with higher magnification, and the observation results as follows have been obtained.

First, within the range of 100 nm from the end of the film comprising carbon (carbon film) 10 facing the first gap 7 toward the electrodes 2 and 3, there have existed portions over a wide range in the carbon film 10 where lattice fringes (lattice image) orientated in the approximately parallel direction (not less than −45° and not more than +45° C. against the substrate surface) to the surface of the substrate have been observed (FIGS. 18A and 18B). Moreover, when the interval of those lattice fringes (lattice image) have been measured, the range has been observed to be from 3.5 to 4.3 Å. In addition, when the observation image of the carbon film 10 in that region has undergone Fourier transform to obtain diffraction pattern, there have existed portions where diffraction ring having maximum intensity in the vicinity of the parallel direction (not less than −45° and not more than +45° C. against the substrate surface) to the surface of the substrate have been measured. In addition, the interval of the lattice fringes (lattice image) obtained from the distance between the positions with maximum intensity of diffraction ring and the origin point of the diffraction pattern has been within the range of 3.5 to 4.3 Å.

In addition, the intensity of the diffraction ring with maximum intensity in a direction has been divided by the intensity of the diffraction ring in the direction perpendicular with the above-mentioned direction to give a ratio which have been measured to be 2.5 or more.

In addition, in such place of the carbon film 10 that is apart from the aforementioned range to get closer to the electrodes 2 and 3, there have existed portions over a wide range where lattice fringes (lattice image) orientated in the approximately normal direction (not less than −30° and not more than +30° against the substrate surface) to the surface of the substrate have been observed as shown (FIGS. 19A and 19B). Moreover, when the interval of those lattice fringes (lattice image) have been measured, that interval has ranged from 3.7 to 4.7 Å. In addition, when the observation image of the carbon film 10 in that region has undergone Fourier transform to obtain diffraction pattern, there have existed portions where diffraction ring having maximum intensity in the vicinity of the normal direction (not less than −30° and not more than +30° C. against the substrate surface) against the surface of the substrate have been measured. Moreover, the interval of the lattice fringes (lattice image) obtained from the distance between the positions with maximum intensity of diffraction ring and the origin point of the diffraction pattern has been within the range of 3.7 to 4.7 Å. In addition, the intensity of the diffraction ring with maximum intensity in a direction has been divided by the intensity of the diffraction ring in the direction perpendicular with the above-mentioned direction to give a ratio which have been 2.5 or more.

Careful observation has been implemented on borderline the portions where the lattice fringes (lattice image) orientated in the vicinity of the parallel direction (more than −45° and less than +45°) to the above-described substrate surface are observed and the portions where the lattice fringes (lattice image) orientated in the vicinity of the normal direction (more than −30° and less than +30°) to the above-described substrate surface are observed, and as shown in FIG. 20, in these portions, the lattice fringes (lattice image) have not shown any particular orientation.

EXAMPLE 5

The present example is the producing method of the electron source of matrix wiring schematically shown in FIG. 14, and of the image forming apparatus (FIG. 9) using this electron source.

FIG. 14 is a partial plan view showing as a schematic diagram the configuration of the electron source of the matrix wiring formed by the present example, and the sectional configuration along a polygonal line 15—15 in the drawing is shown in FIG. 15. With reference to FIGS. 16A to 16D and FIGS. 17E to 17G, the manufacturing step of the electron source is described, and moreover the manufacturing step of the image forming apparatus is also described as follows.

Step-A

Silicon oxide film of 0.5 μm has been formed by a sputtering method on a blue plate glass which has been cleaned, and the product is treated as the substrate, and Cr 5 nm and Au 600 nm have been film-formed thereon by vacuum evaporation method in succession, thereafter, the photoresist AZ1370 (produced by Hoechst Corp.) has been used to form the underlining wiring 82 by photolithography technology. (FIG. 16A)

Step-B

Next, the inter-layer insulation layer 141 made of silicon oxide film with thickness of 1 μm is deposited by sputtering method. (FIG. 16B)

Step-C

A photoresist pattern to form contract holes 142 in the inter-layer insulation layer is produced, and with this as a mask, the inter-layer insulation layer 141 has undergone etching by RIE (Reactive Ion Etching) method using $CF_4$ and $H_2$. (FIG. 16C)

Step-D

A mask pattern of photoresist (RD-2000N-41: produced by Hitachi Chemical Co.) having openings corresponding to the pattern of the element electrode has been formed, and Ti 5 nm and Ni 100 nm have been deposited thereon by vacuum evaporation in succession, and next, the photoresist has been removed by an organic solvent, and the device electrodes 2 and 3 are formed by lift-off. The interval between the device electrodes has been set at 3 μm. (FIG. 16D)

Step-E

The upper wiring 83 having lamination configuration of Ti 5 nm and Au 500 nm has been formed by photolithography method using the photoresist similar to that in the step-A. (FIG. 17E)

Step-F

The conductive film 4 made of PdO has been formed by lift-off using the Cr mask similar to that in the step-b of the example 1. (FIG. 17F)

Step-G

The resist pattern covering other than the contact holes 142 has been formed, and Ti 5 nm and Au 500 nm have been deposited in succession by vacuum evaporation, and the resist pattern has been removed and unnecessary laminated film has been removed and the contact holes have been filled in, and the electron source substrate prior to forming has been produced. (FIG. 17G)

Using the above-described electron source prior to forming step, the image forming apparatus having configuration shown in FIG. 9 has been produced.

The above-described substrate 1 of the electron source prior to forming step has been fixed in the rear plate 91, and the face plate 96 has been disposed upper 5 mm of the substrate 1 via the supporting frame 92, and flit glass has been applied on the bonding portions, and the temperature has been maintained at 400° C. for 10 minutes in nitrogen atmosphere and bonding has been implemented to form the enclosure. The fluorescent film 94 and the metal back 95 have been formed on the interior wall surface of the face plate. The fluorescent film 94 shaped stripe (FIG. 6A) has been adopted and formed by print processes. For the black conductive member, quality of materials comprising graphite as a main component has been used. The metal back has been formed by vacuum-evaporating Al after smoothing processing (filming) has been implemented on the interior surface of the fluorescent film.

At the time when the above-described assembly is implemented, it is necessary to proceed with corresponding to the fluorescent body and the electron-emitting device accurately, and the positioning has been conducted sufficiently. Incidentally, to inside the enclosure, a getter (not shown) is also attached.

Step-H

The above-described enclosure has been connected with the evacuation apparatus via the not-shown exhaust tube, and the gas inside the enclosure has been evacuated to reach $1.3\times10^{-5}$ Pa. And thereafter, through each wiring, the triangular wave pulses have been applied similarly to the step-c of the example 1 to implement the forming step and the first gap has been formed.

Step-I

In succession, the activation processing has been implemented under the same conditions as the step-d of the example 4, and the film containing carbon has been formed.

Step-J

Next, similarly to the step-e of the example 4, while the interior of the enclosure has been evacuated, it has been heated and the stabilization step has been implemented. And as a result, the interior pressure of the enclosure has reached $1.3\times10^{-6}$ Pa in approximately three hours.

Similar to in the example 4, the electron emission characteristic has been measured, revealing that all the devices have emitted electrons normally.

Not-shown driving circuit has been attached to the enclosure produced by the steps mentioned so far, and a high voltage of 10 kV has been applied to the metal back and the TV signals have been inputted to cause images to be displayed, then no phenomena regarded as discharge have not taken place, highly bright and highly minute images have been obtained on stable basis over a long time period.

Comparing Example

In the present comparing example, the electron-emitting device has been produced with steps from the step-a through the step-c being similar to those in the example 4.

Step-d

Next, while the gas inside the vacuum chamber 35 has been being evacuated with the evacuation apparatus 36, the pressure has reached not more than $1\times10^{-6}$ Pa. Thereafter, acetone has been introduced until the pressure has reached $1.3\times10^{-2}$ Pa and after waiting until the pressure has been stabilized, the rectangular pulses which inverse polarities have been applied to between the electrodes 2 and 3 with the wave height value as shown in FIG. 15 being gradually increased. Here, the pulse width T3 has been set at 1 msec., and the pulse interval T4 has been set at 10 msec., and the wave height value has been gradually increased from 10 V to 15 V over 35 minutes. Thereafter, the rectangular pulses as shown in FIG. 13A which inverse polarities with the constant wave height value have been repeatedly applied to between the device electrodes. The wave height value has been set at 15 V, the pulse width T3 has been set at 1 msec., and the pulse interval T4 has been set at 10 msec.

Step-e

Next, the device has been heated to reach 150° C. and maintained thereat while the gas inside the vacuum chamber 35 has been evacuated with the evacuation apparatus 36, then the pressure has reached $1.3\times10^{-6}$ Pa.

Next, after the device has been returned to the room temperature, similar to in the example 1, a voltage of 8 kV has been applied to the anode electrode 34, and the rectangular pulses which inverse polarities with the constant wave height value have been applied to between the device electrodes, and features thereof have been measured. Incidentally, the distance between the anode electrode and the device has been set at 4 mm.

The device of the present comparing example has been driven for a constant time period, revealing that the device currents If and emission current Ie have been gradually reduced. In addition, the phenomena to be regarded as discharge have been observed several time during this driving.

Next, similar to in the example 4, using FIB-TEM method, a cross-sectional observation on the form of the electron-emitting device of the present comparing example has been implemented. At first, the observation has taken place with a low magnification, it has been found out that there exist portions where not only inside the gap but also on the conductive film surrounding it the film comprising carbon 10 with thickness of not less than the level of 10 nm has been formed. Next, when the deposits have been observed at a higher magnification, the observation results as follows have been obtained.

At first, in the region apart from the first gap 7 by 100 nm, lattice fringes (lattice image) have been observed at some portions, but no particular orientations have been shown.

Next locations beyond the region at 100 nm from the above-described first gap 7 have been observed, but no places where the lattice fringes (lattice image) are observed have not have not been able to be found out.

As described so far, in the electron-emitting device of the present invention, the film comprising carbon which has been deposited on the substrate inside the gap having formed in the conductive film and on the conductive film is orientated in the approximately normal direction against the substrate surface and/or the conductive film surface.

Moreover, in the region closest to the electron emission portion, that is, in the location where two parties are facing each other via the first gap, the above-described lattice fringes (lattice image) of the film comprising carbon are orientated in the approximate parallel direction to the substrate surface.

Therefore, the majority of the surface of the film comprising carbon (carbon film) contacting the vacuum is thermally and chemically stable.

Moreover, in the region where the film comprising carbon connects the region closest to the first gap 7, which has been orientated in the approximate parallel direction to the substrate surface, with the region apart from the first gap 7, which has been orientated in the approximately normal direction against the substrate surface, it is thought that no particular orientation to be held will enable the film comprising carbon not to save any necessary stress. As a result thereof, the shape of the film comprising carbon is thought to be thermally stable.

Consequently, various kinds of evaporation from the carbon film and compositional change in carbon film due to the temperature increase at the time of driving of the electron-emitting device, and heating at the time of assembling the image forming apparatus are suppressed and moreover the influence by the absorption of impurities, etc. is reduced.

According to the advantages described so far, the electron-emitting device having electron emission characteristic which is highly efficient and stable over a long time period has been obtained.

Moreover, in the image forming apparatus using an electron source in which a number of the electron-emitting devices of the present invention have been arranged and formed over a large area, the electron-emitting devices are extremely stable even if they are highly densely disposed to obtain highly minute images, and such an image forming apparatus that has a long life even if a higher anode voltage has been applied, and is highly reliable and can provide highly bright and highly quality images has been completed.

What is claimed is:

1. An electron-emitting device comprising first and second carbon films disposed on a surface of a substrate, and first and second electrodes electrically connected to the first and the second carbon films, respectively, wherein the carbon films have a first region showing orientation, and a direction of the orientation is approximately parallel to the surface of the substrate, and wherein the direction of the orientation is not less than −45 degrees and not more than +45 degrees against the surface of the substrate.

2. The electron-emitting device according to claim 1, wherein at least one of said carbon films further has a second region orientated in a direction approximately normal to the surface of said substrate.

3. The electron-emitting device according to claim 2, wherein the direction approximately normal to the surface of said substrate is not less than −30 degrees and not more than +30 degrees from a normal direction against the surface of said substrate.

4. The electron-emitting device according to claim 2, wherein the second region is disposed between the first region and said electrodes.

5. The electron-emitting device according to claim 2, wherein the at least one of said carbon films has a third region without any particular orientation, and said third region is disposed between the first region and the second region.

6. An electron-emitting device comprising first and second electrodes disposed on a surface of a substrate, and a carbon film electrically connected to the first and second electrodes, wherein the carbon film has a first gap, and has a first region showing orientation, and a direction of the orientation is approximately parallel to the surface of the substrate, and wherein the direction of the orientation is not less than −45 degrees and not more than +45 degrees against the surface of the substrate.

7. The electron-emitting device according to claim 6, wherein the first region faces the first gap.

8. The electron-emitting device according to claim 7, wherein said first region is disposed in a region of a distance of not more than 100 nm from an end portion of said carbon film facing said first gap toward a direction of said electrodes.

9. The electron-emitting device according to claim 6, wherein said carbon film further has a second region orientated in a direction approximately normal to the surface of said substrate.

10. The electron-emitting device according to claim 9, wherein the direction approximately normal to the surface of said substrate is not less than −30 degrees and not more than +30 degrees from a normal direction against the surface of said substrate.

11. The electron-emitting device according to claim 9, wherein the second region is disposed between the first region and said electrodes.

12. The electron-emitting device according to claim 9, wherein said carbon film has a third region without any particular orientation, and said third region is disposed between the first region and the second region.

13. The electron-emitting device according to claim 6, wherein said carbon film and the first and the second electrodes are connected via an electroconductive film.

14. An electron source comprising a plurality of electron-emitting devices which have been arranged and formed on a substrate, wherein each electron-emitting device is the electron-emitting device according to claim 1 or 6.

15. An image forming apparatus comprising an electron source and an image forming member forming images with electrons to be emitted from the electron source being radiated, wherein the electron source is an electron source according to claim 14.

16. An electron-emitting device comprising:

(a) first and second electrconductive films electrically connected to first and second electrodes, respectively, on a substrate surface, and disposed between the first and second electrodes;

(b) a first carbon film, part of the first carbon film being disposed on the first electroconductive film and another part of the first carbon film being disposed between the first and second electroconductive films;

(c) a second carbon film, part of the second carbon film being disposed on the second electroconductive film and another part of the second carbon film being disposed between the first and second electroconductive films;

wherein said first and second carbon films have a region showing orientation, on the first and second electroconductive films, and wherein a direction of the orientation is an approximately normal direction relative to the substrate surface.

17. An electron-emitting device comprising:

first and second electrodes disposed on a surface of a substrate;

an electroconductive film connecting said first and second electrodes and including a second gap;

a carbon film connected to said electroconductive film and including a first gap;

wherein said first gap is disposed inside said second gap, and said carbon film has, on said electroconductive film, a first region showing orientation, and a direction of the orientation is approximately normal to the surface of said substrate.

18. The electron-emitting device according to claim 16 or 17, wherein the direction is not less than −30 degrees and not more than +30 degrees relative to the surface of the substrate.

19. The electron-emitting device according to claim 17, wherein said carbon film further has a second region orientated in an approximately parallel direction to the surface of said substrate.

20. The electron-emitting device according to claim 19, wherein said approximately parallel direction is not less than −45 degrees and not more than +45 degrees along the surface of said substrate.

21. The electron-emitting device according to claim 19, wherein the second region faces said first gap.

22. The electron-emitting device according to claim 19, wherein said second region is disposed in a region of a distance of not more than 100 nm from an end portion of said carbon film facing said first gap toward a direction of said electrodes.

23. The electron-emitting device according to claim 19, wherein the first region is disposed between the second region and said electrodes.

24. The electron-emitting device according to claim 19, wherein said carbon film has a third region without any particular orientation, and said third region is disposed between the first region and the second region.

25. An electron source comprising a plurality of electron-emitting devices which have been arranged and formed on a substrate, wherein the electron-emitting device is the electron-emitting device according to claim 16 or 17.

26. An image forming apparatus comprising an electron source and an image forming member forming images with electrons to be emitted from the electron source being radiated, wherein the electron source is an electron source according to claim 25.

27. An electron-emitting device comprising first and second carbon films which are disposed on a surface of a substrate with a first gap therebetween, and first and second electrodes having an electrical connection to the first and second carbon films, respectively, wherein each of the first and second carbon films has a first region including graphite (002) planes stacked in a direction approximately parallel to the surface of the substrate.

28. The electron-emitting device according to claim 27, wherein said first and second carbon films are connected to part of the first and second electrodes, respectively.

29. The electron-emitting device according to claim 27, wherein the graphite (002) planes are stacked in a direction not less than −45 degrees and not more than +45 degrees against the surface of the substrate.

30. The electron-emitting device according to claim 27, wherein the first region faces the first gap.

31. The electron-emitting device according to claim 27, wherein the first region is disposed in a region located at a distance of not more than 100 nm from an end portion of at least one of the carbon films facing the first gap toward a direction of the electrodes.

32. The electron-emitting device according claim 27, wherein each of the first and second carbon films has a second region including graphite (002) planes stacked in a direction approximately normal to the surface of the substrate.

33. The electron-emitting device according to claim 32, wherein the first region in each of the first and second carbon films is disposed between the first gap and the second region in each of the first and second carbon films.

34. The electron-emitting device according to claim 32, wherein the second region is disposed between the first region and the electrodes.

35. The electron-emitting device according to claim 32, wherein each of the carbon films has a third region between the first region and the second region thereof and in the third region directions in which graphite (002) planes are stacked and are random.

36. The electron-emitting device according to claim 27, wherein the first carbon film and the first electrode are connected via a first electoconductive film, and the second carbon film and the second electrode are connected via a second electroconductive film.

37. The electron emitting device according to claim 36, wherein a part of the first carbon film is disposed on the first electroconductive film and another part of the first carbon film is disposed between the first and second electroconductive films, and a part of the second carbon film is disposed on the second electroconductive film and another part of the second carbon film is disposed between the first and second electroconductive films.

38. An electron source comprising a plurality of electron-emitting devices which have been arranged and formed on a substrate, wherein each electron-emitting device is an electron-emitting device according to any one of claims 27 through 36.

39. An image forming apparatus comprising an electron source and an image forming member which forms images in response to being irradiated with electrons emitted from the electron source, wherein the electron source is an electron source according to claim 38.

* * * * *

UNITED STATES PATENT AND TRADEMARK OFFICE

CERTIFICATE OF CORRECTION

PATENT NO. : 6,917,146 B1 
APPLICATION NO. : 09/443308
DATED : July 12, 2005
INVENTOR(S) : Taiko Motoi et al.

It is certified that error appears in the above-identified patent and that said Letters Patent is hereby corrected as shown below:

TITLE PAGE AT (30) FOREIGN APPLICATION PRIORITY DATA

"Feb. 22 1999 (JP) …… 11-0142908" should read --Feb. 22, 1999 (JP) ..... 11-042908--.

TITLE PAGE AT (56) FOREIGN PAGENT DOCUMENTS

"EP 0 701 265 3/1996" should read --EP 0 701 265 A1 3/1996--; and
"JP 0 701 265 A1 3/1996" should be deleted.

COLUMN 1

Line 21, "emission"," should read --Emission",--;
Line 22, "thin-film field emission" should read --Thin-film Field Emission--;
Line 23, "cathodes with molybdenium cones" should read --Cathodes with Molybdenum Cones--; and
Line 26, "Mead", Operation" should read --Mead, "Operation--.

COLUMN 2

Line 5, "stable" should read --a stable--;
Line 7, "istics controllable on stable" should read --istics are controllable on a stable--;
Line 14, "being" should read --acting as--;
Line 15, "lighten" should read --cause--;
Line 21, "or" should read --or during--;
Line 25, "driving" should read --driving,--;
Line 40, "circumstance," should read --circumstances,--;
Line 48, "Further" should read --Further,--; and
Line 66, "having." should read --being--.

COLUMN 3

Line 8, "covers" should read --cover--;
Line 28, "stable" should read --a stable--;
Line 30, "excellent" should read --are excellent--;
Line 34, "stable" should read --a stable--;
Line 44, "example of" should read --example--;
Line 48, "of" should be deleted; and
Line 49, "manufacturing" should read --a manufacturing--.

UNITED STATES PATENT AND TRADEMARK OFFICE

CERTIFICATE OF CORRECTION

PATENT NO. : 6,917,146 B1
APPLICATION NO. : 09/443308
DATED : July 12, 2005
INVENTOR(S) : Taiko Motoi et al.

It is certified that error appears in the above-identified patent and that said Letters Patent is hereby corrected as shown below:

COLUMN 4

Line 15, “of” should read --of an--;
Line 25, “manfacturing” should read --the manfacturing--;
Line 44, “of” should read --of an--;
Line 47, “of” (first occurrence) should read --of an--; and
Line 53, “drawings” should read --drawings,--.

COLUMN 5

Line 59, “of approximate” should read --approximately--.

COLUMN 6

Line 13, “of” should be deleted;
Line 14, “approximate” should read --approximately--;
Line 19, “to heating” should read --to the heating--;
Line 27, “having” should be deleted;
Line 52, “having” should be deleted; and
Line 56, “where” should read --where the--.

COLUMN 7

Line 12, “on” should read --of--;
Line 13, “having been” should be deleted;
Line 31, “having” should be deleted;
Line 38, “to the” should be deleted;
Line 60, “further long” should read --longer--; and
Line 47,“does” should read --do--.

COLUMN 8

Line 6, “is” should read --is a--;
Line 7, “rations that” should read --ration in which--;
Line 13, “the both” should read --both--;
Line 14, “parties” should read --parts--; and “doe” should read --do--;
Line 40, “are” should read --is--;
Line 46, “this” should be deleted;
Line 47, “length” should read --a length--; and
Line 65, “have” should read --has--.

UNITED STATES PATENT AND TRADEMARK OFFICE

CERTIFICATE OF CORRECTION

PATENT NO. : 6,917,146 B1
APPLICATION NO. : 09/443308
DATED : July 12, 2005
INVENTOR(S) : Taiko Motoi et al.

It is certified that error appears in the above-identified patent and that said Letters Patent is hereby corrected as shown below:

COLUMN 9

Line 11, “have” should read --has--;
Line 26, “inconveniences” should read --inconvience--;
Line 31, “is” should read --are--;
Line 43, “using for example” should read --using, for example,--; and
Line 46, “costly” should read --a cost--.

COLUMN 10

Line 26, “of for” should read --of, for--;
Line 27, “example” should read --example,--; and “not-shown” should read --a not-shown--;
Line 29, “applying” should read --apply--;
Line 34, “continuous” should read --a continuous--;
Line 35, “having” should be deleted;
Line 36, “having” should be deleted;
Line 42, “of for example” should read --of, for example,--;
Line 43, “ten” should read --tens of--; and “from” should read --form--;
Line 45, “can be” should read --can also be--;
Line 52, “for” should read --for the--;
Line 55, “resistant” should read --resistance--;
Line 57, “resistant” should read --resistance--;
Line 61, “form” should read --forms--;
Line 66, “acrylonitrile” should read --acrylonitrile,--; and
Line 67, “to” should be deleted.

COLUMN 11

Line 57, “possible, but heating” should read --possible. Heating--; and
Line 67, “processing” should read --processing,--.

COLUMN 12

Line 4, “feature” should read --features--;
Line 7, “etc. which absorbed” should read --etc., which is absorbed--;
Line 14, “is applicable” should be deleted;
Line 53, “drawing having schematically shown” should read --graph showing--; and
Line 64, “istic” should read --istics--.

UNITED STATES PATENT AND TRADEMARK OFFICE

CERTIFICATE OF CORRECTION

PATENT NO. : 6,917,146 B1
APPLICATION NO. : 09/443308
DATED : July 12, 2005
INVENTOR(S) : Taiko Motoi et al.

It is certified that error appears in the above-identified patent and that said Letters Patent is hereby corrected as shown below:

COLUMN 13

Line 51, “considering” should read --considering the--;
Line 53, “to” should be deleted;
Line 54, “micro mete” should read --micrometer--; and
Line 65, “in only the point” should read --only--.

COLUMN 14

Line 15, “ends each” should read --ends to each--; and
Line 65, “the both” should read --both--.

COLUMN 15

Line 5, “and,” should read --and--; and “espe-” should be deleted;
Line 6, “cially” should be deleted;
Line 20, “from for example” should read --from, for example,--;
Line 47, “is” should read --are--;
Line 51, “to” should be deleted;
Line 54, “electron” should read --an electron--; and “emitted a” should read --emitted, a--; and
Line 62, “source” should read --sources--.

COLUMN 16

Line 22, “thus” should be deleted;
Line 23, “unnecessary” should read --as unnecessary--;
Line 30, “the atmosphere” should read --atmospheric--;
Line 33, “only” should read --only the--;
Line 46, “has” should read --have--; and
Line 52, “to provide” should read --of providing--;
Line 53, “from radiation” should read --to radiate--;
Line 54, “of” (first occurrence) should read --off--; and “to direction” should read --in the direction--;
Line 55, “cause to act as electrode” should read --cause it to act as an electrode--;
Line 57, “bombering” should read --bombarding--; and
Line 60, “surface of” (first occurrence) should be deleted.

UNITED STATES PATENT AND TRADEMARK OFFICE

CERTIFICATE OF CORRECTION

PATENT NO. : 6,917,146 B1
APPLICATION NO. : 09/443308
DATED : July 12, 2005
INVENTOR(S) : Taiko Motoi et al.

It is certified that error appears in the above-identified patent and that said Letters Patent is hereby corrected as shown below:

COLUMN 17

Line 19, “outline” should read --the outline--;
Line 20, “especially” should be deleted; and
Line 67, “each” should be deleted.

COLUMN 18

Line 3, “passing-” should read --pass---;
Line 45, “with aceton,” should read --the substrate in which electrodes have been formed with acetone,--; and “the substrate in” should be deleted; and
Line 46, “which electrodes have been formed” should be deleted--.

COLUMN 19

Line 17, “Pas,” should read --Pa,--;
Line 19, “which” should read --with--;
Line 20, “to” should be deleted;
Line 27, “which” should read --with--;
Line 28, “to” should be deleted;
Line 41, “to” should be deleted; and
Line 62, “it the” should read --it, the--.

COLUMN 20

Line 2, “of” should read --of the--;
Line 9, “obtain” should read --obtain a--;
Line 12, “of” should read --of the--;
Line 21, “have” should read --has--; and
Line 54, “produced, and” should read --produced and,--.

UNITED STATES PATENT AND TRADEMARK OFFICE

CERTIFICATE OF CORRECTION

PATENT NO. : 6,917,146 B1
APPLICATION NO. : 09/443308
DATED : July 12, 2005
INVENTOR(S) : Taiko Motoi et al.

It is certified that error appears in the above-identified patent and that said Letters Patent is hereby corrected as shown below:

COLUMN 21

Line 40, “to” should be deleted;
Line 46, “pomp),” should read --pump),--; and
Line 62, “, and” should read --.--;
Line 63, “a” should read --A--;
Line 65, “displayed, then no” should read --displayed. No--;
Line 66, “not” should be deleted; and “place, highly” should read --place and highly--; and
Line 67, “stable” should read --a stable--.

COLUMN 22

Line 8, “reach” should read --reaches--;
Line 12, “to” should be deleted;
Line 17, “to” should be deleted; and
Line 22, “to” should be deleted--.

COLUMN 23

Line 4, “with” should read --the substrate in which electrodes have been formed with--; and “the substrate” should be deleted;
Line 5, “in which electrodes have been formed” should be deleted;
Line 39, “has” should read --is--; and
Line 40, “been” should read --being--;
Line 46, “to” should be deleted;
Line 50, “to” should be deleted; and
Line 58, “to” should be deleted.

COLUMN 24

Line 27, “in” should read --by--;
Line 28, “magnification,” should read --magnification and--;
Line 29, “out” should read --that--;
Line 31, “it the” should read --it, that the--;
Line 32, “the level of” should be deleted; and
Line 34, “width” should read --the width--.

UNITED STATES PATENT AND TRADEMARK OFFICE

CERTIFICATE OF CORRECTION

PATENT NO. : 6,917,146 B1
APPLICATION NO. : 09/443308
DATED : July 12, 2005
INVENTOR(S) : Taiko Motoi et al.

It is certified that error appears in the above-identified patent and that said Letters Patent is hereby corrected as shown below:

COLUMN 25

Line 23, “have” should read --has--; and
Line 24, “borderline” should read --the borderline of--.

COLUMN 27

Line 7, “in” should be deleted;
Line 11, “far, and a” should read --far. A--;
Line 14, “displayed, then no” should read --displayed. No--;
Line 15, “not” should be deleted; and “place, highly” should read --place and highly--;
Line 16, “stable” should read --a stable--;
Line 29, “which” should read --with--;
Line 30, “to” should be deleted;
Line 37, “to” should be deleted;
Line 50, “to” should be deleted;
Line 58, “time” should read --times--;
Line 61, “in” should be deleted;
Line 66, “portions where” should read --portions,--; and
Line 67, “it the” should read --it, that the--.

COLUMN 28

Line 1, “the level of” should be deleted;
Line 11, “not have not been able to be found out.” should read --been found.--;
Line 33, “to be held” should be deleted;
Line 34, “not to save any necessary” should read --to exhibit less--; and
Line 57, “highly quality” should read --high quality--.

COLUMN 29

Line 62, “electrconductive” should read --electroconductive--.

COLUMN 30

Line 2, “films;” should read --films; and.--; and
Line 16, “gap;” should read --gap; and--.

UNITED STATES PATENT AND TRADEMARK OFFICE

CERTIFICATE OF CORRECTION

PATENT NO. : 6,917,146 B1
APPLICATION NO. : 09/443308
DATED : July 12, 2005
INVENTOR(S) : Taiko Motoi et al.

It is certified that error appears in the above-identified patent and that said Letters Patent is hereby corrected as shown below:

COLUMN 32

Line 1, "thereof" should read --thereof,--;
Line 3, "and are" should read --are--; and
Line 6, "electoconductive" should read --electroconductive--.

Signed and Sealed this

Fourteenth Day of November, 2006

JON W. DUDAS
*Director of the United States Patent and Trademark Office*